US007682768B2

(12) United States Patent
Kurokawa

(10) Patent No.: US 7,682,768 B2
(45) Date of Patent: Mar. 23, 2010

(54) PRODUCTION PROCESS OF POLYMERIZED TONER

(75) Inventor: Hisashi Kurokawa, Tokyo (JP)

(73) Assignee: Zeon Corporation, Tokyo (JP)

( * ) Notice: Subject to any disclaimer, the term of this patent is extended or adjusted under 35 U.S.C. 154(b) by 826 days.

(21) Appl. No.: 11/340,500

(22) Filed: Jan. 27, 2006

(65) Prior Publication Data

US 2006/0172221 A1 Aug. 3, 2006

(30) Foreign Application Priority Data

Jan. 28, 2005 (JP) ..... 2005-021920
Feb. 24, 2005 (JP) ..... 2005-049086

(51) Int. Cl.
*G03G 9/08* (2006.01)

(52) U.S. Cl. ..... 430/137.17; 430/137.15; 430/137.19

(58) Field of Classification Search ..... 430/137.15, 430/137.17, 137.19
See application file for complete search history.

(56) References Cited

U.S. PATENT DOCUMENTS 6,309,788 B1 * 10/2001 Tsuji et al. ..... 430/137.17
6,534,233 B1 3/2003 Yamamoto et al. .... 430/137.171
2004/0096767 A1 * 5/2004 Tsuji et al. ..... 430/137.17

FOREIGN PATENT DOCUMENTS

JP 06-075429 3/1994
JP 2003-287921 * 10/2003

OTHER PUBLICATIONS

English translation of JP 2003-287921 published Oct. 10, 2003.*

* cited by examiner

*Primary Examiner*—Mark F Huff
*Assistant Examiner*—Peter L Vajda
(74) *Attorney, Agent, or Firm*—Westerman, Hattori, Daniels & Adrian, LLP

(57) ABSTRACT

A process for producing a polymerized toner, comprising the step of polymerizing a polymerizable monomer composition containing a polymerizable monomer and a colorant in the presence of a polymerization initiator in an aqueous dispersion medium to form colored polymer particles, the process comprising the steps of mixing the polymerizable monomer with the colorant to prepare a polymerizable monomer mixture having an initial viscosity of 10 to 3,000 mPa·s or 0.3 to 1 mPa·s as measured at 25° C. by a Brookfield type viscometer, and then feeding the polymerizable monomer mixture to a media type dispersing machine to finely disperse the colorant by the media type dispersing machine, thereby preparing a dispersed polymerizable monomer mixture having a viscosity after the dispersion, the ratio of increase in viscosity of which is 1.0 to 10 times or 100 to 2,000 times as high as the initial viscosity.

10 Claims, 2 Drawing Sheets

PRODUCTION PROCESS OF POLYMERIZED TONER

BACKGROUND OF THE INVENTION

1. Field of the Invention

The present invention relates to a production process of a polymerized toner used in development for copying machines, facsimiles, printers and the like by an electrophotographic system.

2. Description of the Related Art

In recent years, image forming apparatus using an electrophotographic system, such as copying machines and printers, have rapidly trended toward formation of full-color images. In color printing by the electrophotographic system, even high-definition images including photographs are printed, so that there is a particular demand for printing high in resolution and good in color reproducibility. Therefore, high-quality color toners, which can meet requirements for such high printing property, are required.

In order to meet the above requirements, it is known that the use of a spherical toner improves transferability and developability and is suitable for high resolution. Since a polymerization process such as a suspension polymerization process or emulsion polymerization process can efficiently produce a spherical toner, it is suitable for use as a production process thereof. A toner produced by such a polymerization process is called "a polymerized toner".

In the polymerization process, a polymerizable monomer composition comprising a polymerizable monomer and a colorant is generally suspended or emulsified in an aqueous dispersion medium to form fine droplets, and the fine droplets are then polymerized, thereby producing colored polymer particles. The colored polymer particles are used as polymerized toner particles. In order to obtain a polymerized toner capable of conducting printing high in resolution and good in color reproducibility, it is necessary to finely and uniformly disperse the colorant in the polymerizable monomer composition. In order to finely and uniformly disperse the colorant, there is a method in which high shearing force is applied to a mixture containing the polymerizable monomer and the colorant to stir the mixture, thereby dispersing the colorant. As a dispersing machine, various kinds of media type dispersing machines containing media particles are generally used.

For example, Japanese Patent Application Laid-Open No. 6-75429 discloses a production process of a polymerized toner, which comprises the steps of dispersing a colorant in a monomer composition containing at least a polymerizable monomer, dispersing this monomer composition in an aqueous medium to form suspended particles and polymerizing the resultant suspended particles, wherein in the dispersing step, an initial viscosity of the monomer composition is controlled within a range from 1 to 100 mPa·s, and the resultant prepared liquid is then dispersed by means of a media type dispersing machine to control the viscosity after the dispersion within a range from 10 to 1,000 times as high as the initial viscosity.

In Examples of Japanese Patent Application Laid-Open No. 6-75429, a media type dispersing machine having a separation part for separating media particles is used as a media type dispersing machine. In this process, the viscosity of a polymerizable monomer composition greatly changes during the dispersing treatment, so that the colorant is hard to be uniformly dispersed, and further, the media particles are unevenly distributed in the separation part to lower dispersing efficiency. Therefore, this process has involved a problem that the dispersion level of the colorant becomes insufficient, or the time required for dispersion becomes long, and so production efficiency is greatly lowered.

U.S. Pat. No. 6,534,233 has proposed a production process of a polymerized toner, which comprises the dispersion step of dispersing a colorant in a dispersion medium containing a polymerizable monomer under conditions of a tip speed (peripheral speed) of an agitator (rotor) of 3 to 20 m/sec and a passing time of 0.03 to 0.5 hour by means of a media type dispersing machine to obtain a monomer composition. However, this process also cannot achieve a required dispersion level in the case of a color toner, of which a particularly high dispersion level is required, or takes a very long time to reach the dispersion level. Therefore, the process has involved a problem that production efficiency is worsened.

BRIEF SUMMARY OF THE INVENTION

It is an object of the present invention to provide a process by which a colorant is uniformly and finely dispersed in a polymerizable monomer, whereby the colorant is uniformly and extremely finely dispersed in resulting colored polymer particles, and so a polymerized toner excellent in printing density and color tone can be continuously, stably and efficiently produced.

The present inventors have carried out an extensive investigation as to a dispersion step of dispersing a colorant in a monomer mixture containing a polymerizable monomer and the colorant. As a result, it has been found that a polymerizable monomer mixture having an initial viscosity within a specified range is prepared, and the polymerizable monomer mixture is then subjected to a dispersing treatment by a media type dispersing machine to control the dispersing treatment by the media type dispersing machine in such a manner that a ratio of increase in viscosity to the initial viscosity falls within a specified range, whereby the above object can be achieved.

Specifically, the polymerizable monomer is mixed with the colorant to prepare a polymerizable monomer mixture having an initial viscosity of 10 to 3,000 mPa·s as measured at 25° C. by a Brookfield type viscometer, and the polymerizable monomer mixture is then fed to the media type dispersing machine to finely disperse the colorant by the media type dispersing machine, thereby preparing a dispersed polymerizable monomer mixture having a viscosity after the dispersion, the ratio of increase in viscosity of which is 1.0 to 10 times as high as the initial viscosity. The dispersed polymerizable monomer mixture is provided as a polymerizable monomer composition as it is, or other additive components for toner than the colorant are dissolved or dispersed in the dispersed polymerizable monomer mixture to prepare a polymerizable monomer composition. The additive components for toner include a charge control agent and the like. This polymerizable monomer composition is dispersed in an aqueous dispersion medium to form droplets of the polymerizable monomer composition, and polymerization is then conducted in the presence of a polymerization initiator to form colored polymer particles.

As another mode, there is a process, in which in the dispersion step, the polymerizable monomer is mixed with the colorant to prepare a polymerizable monomer mixture having an initial viscosity of 0.3 to 1 mPa·s as measured at 25° C. by a Brookfield type viscometer, and the polymerizable monomer mixture is then fed to the media type dispersing machine to finely disperse the colorant by the media type dispersing machine, thereby preparing a dispersed polymerizable monomer mixture having a viscosity after the dispersion, the ratio of increase in viscosity of which is 100 to 2,000 times as high as the initial viscosity.

In order to adjust the mixture containing the polymerizable monomer and colorant to the above-described viscosity, preliminary dispersion is preferably conducted by means of another dispersing machine than the media type dispersing machine. When the particle diameter of the colorant used as a starting material is great, or the proportion of coarse particles contained therein is high, a preliminarily dispersing treatment may preferably be conducted, whereby the initial viscosity of the mixture is adjusted, and moreover the volume average particle diameter of the colorant is made small, or the volume percent of the coarse particles is made low.

Unless such preliminary dispersion is conducted, the resulting toner may become insufficient in image density, or clogging by the polymerizable monomer mixture may occur during the dispersion step by the media type dispersing machine. Even when the preliminary dispersion is conducted, a problem that no uniform dispersion is conducted, or a mixture after the dispersion remains in the dispersing machine arises when the viscosity of the preliminarily dispersed polymerizable monomer mixture upon the beginning of the dispersion step using the media type dispersing machine is high.

As the media type dispersing machine, is preferred a media type dispersing machine having a media-separating screen. The particle diameter of the media particles used in this media type dispersing machine is preferably from 0.05 mm to 0.5 mm.

According to the present invention, there is thus provided a process for producing a polymerized toner, comprising the step of polymerizing a polymerizable monomer composition containing a polymerizable monomer and a colorant in the presence of a polymerization initiator in an aqueous dispersion medium to form colored polymer particles, the process comprising the following Steps 1 to 5:

(a) Step 1 of mixing the polymerizable monomer with the colorant to prepare a polymerizable monomer mixture having an initial viscosity of 10 to 3,000 mPa·s as measured at 25° C. by a Brookfield type viscometer;

(b) Step 2 of feeding the polymerizable monomer mixture to a media type dispersing machine to finely disperse the colorant by the media type dispersing machine, thereby preparing a dispersed polymerizable monomer mixture having a viscosity after the dispersion, the ratio of increase in viscosity of which is 1.0 to 10 times as high as the initial viscosity;

(c) Step 3 of providing the dispersed polymerizable monomer mixture as the polymerizable monomer composition as it is, or preparing the polymerizable monomer composition by dissolving or dispersing other additive components for toner than the colorant into the dispersed polymerizable monomer mixture;

(d) Step 4 of dispersing the polymerizable monomer composition in the aqueous dispersion medium to form droplets of the polymerizable monomer composition; and (e) Step 5 of polymerizing the polymerizable monomer composition dispersed as the droplets in the aqueous dispersion medium in the presence of the polymerization initiator to form the colored polymer particles.

According to the present invention, there is also provided a process for producing a polymerized toner, comprising the step of polymerizing a polymerizable monomer composition containing a polymerizable monomer and a colorant in the presence of a polymerization initiator in an aqueous dispersion medium to form colored polymer particles, the process comprising the following Steps I to V:

(1) Step I of mixing the polymerizable monomer with the colorant to prepare a polymerizable monomer mixture having an initial viscosity of 0.3 to 1 mPa·s as measured at 25° C. by a Brookfield type viscometer;

(2) Step II of feeding the polymerizable monomer mixture to a media type dispersing machine to finely disperse the colorant by the media type dispersing machine, thereby preparing a dispersed polymerizable monomer mixture having a viscosity after the dispersion, the ratio of increase in viscosity of which is 100 to 2,000 times as high as the initial viscosity;

(3) Step III of providing the dispersed polymerizable monomer mixture as the polymerizable monomer composition as it is, or preparing the polymerizable monomer composition by dissolving or dispersing other additive components for toner than the colorant into the dispersed polymerizable monomer mixture;

(4) Step IV of dispersing the polymerizable monomer composition in the aqueous dispersion medium to form droplets of the polymerizable monomer composition; and (5) Step V of polymerizing the polymerizable monomer composition dispersed as the droplets in the aqueous dispersion medium in the presence of the polymerization initiator to form the colored polymer particles.

DETAILED DESCRIPTION OF THE INVENTION

Figure 1:
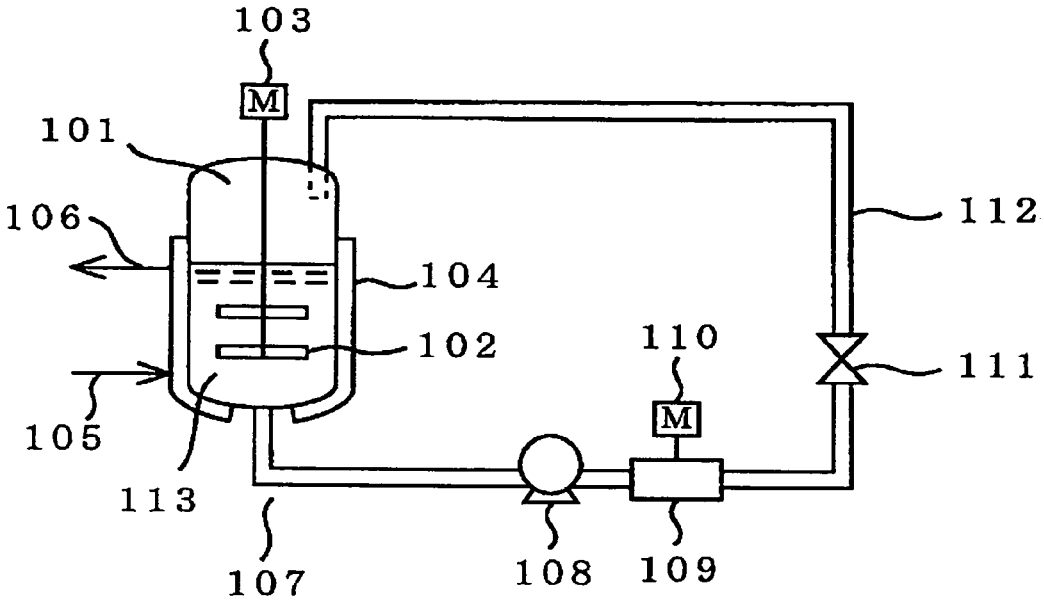
FIG. 1 illustrates a preliminary dispersion system adopted in Examples of the present invention.

The process according to the present invention for producing a polymerized toner comprises the step of polymerizing a polymerizable monomer composition containing a polymerizable monomer and a colorant in the presence of a polymerization initiator in an aqueous dispersion medium to form colored polymer particles. The process according to the present invention for producing the polymerized toner comprises the dispersion step of dispersing the colorant in the polymerizable monomer as a preliminary step prior to polymerization.

According to the first production process of the present invention, the polymerized toner is produced in the following manner.

The polymerizable monomer is first mixed with the colorant to prepare a polymerizable monomer mixture having an initial viscosity of 10 to 3,000 mPa·s as measured at 25° C. by a Brookfield type viscometer (Step 1). In Step 1, another dispersing machine than a media type dispersing machine is preferably used to preliminarily disperse the mixture containing the polymerizable monomer and colorant, thereby preparing a polymerizable monomer mixture having an initial viscosity within the above range. By the preliminary dispersion, the volume average particle diameter of the colorant can be made small, and the proportion of coarse particles contained therein can be made low. Therefore, when the preliminarily dispersed polymerizable monomer mixture is fed to the media type dispersing machine, the media type dispersing machine is prevented from causing clogging or impeding stable and continuous operation.

The polymerizable monomer mixture is then fed to the media type dispersing machine to finely disperse the colorant by the media type dispersing machine, thereby preparing a dispersed polymerizable monomer mixture having a viscosity after the dispersion, the ratio of increase in viscosity of which is 1.0 to 10 times as high as the initial viscosity (Step 2).

Although the dispersed polymerizable monomer mixture may be used as a polymerizable monomer composition as it is, other additive components for toner than the colorant are generally dissolved or dispersed in the dispersed polymerizable monomer mixture to prepare a polymerizable monomer composition (Step 3) Examples of the additive components for toner include a charge control agent, a molecular weight modifier and a mold lubricant.

The polymerizable monomer composition is dispersed in an aqueous dispersion medium to form droplets of the polymerizable monomer composition (Step 4). The polymerizable monomer composition dispersed as the droplets in the aqueous dispersion medium is polymerized in the presence of a polymerization initiator to form colored polymer particles (Step 5).

The colored polymer particles can be used as a polymerized toner as they are. If desired, a polymerizable monomer for shell may be polymerized in the presence of the colored polymer particles, thereby obtaining a core-shell type polymerized toner coated with a shell composed of a polymer layer.

After the polymerization step, the resultant aqueous dispersion of the colored polymer particles is subjected to filtration, washing, dehydration and drying, and is classified as needed, thereby collecting a polymerized toner. To the polymerized toner, an external additive or carrier is added as needed, thereby preparing a developer.

According to the second production process of the present invention, the polymerized toner is produced in the following manner.

The polymerizable monomer is first mixed with the colorant to prepare a polymerizable monomer mixture having an initial viscosity of 0.3 to 1 mPa·s as measured at 25° C. by a Brookfield type viscometer (Step I). The polymerizable monomer mixture is then fed to the media type dispersing machine to finely disperse the colorant by the media type dispersing machine, thereby preparing a dispersed polymerizable monomer mixture having a viscosity after the dispersion, the ratio of increase in viscosity of which is 100 to 2,000 times as high as the initial viscosity (Step II). Other steps are the same as those in the first production process.

In the present invention, the polymerizable monomer means a polymerizable compound. A monovinyl monomer is used as a main component of the polymerizable monomer. Examples of the monovinyl monomer include styrene; styrene derivatives such as vinyltoluene and α-methylstyrene; acrylic acid and methacrylic acid; acrylates such as methyl acrylate, ethyl acrylate, propyl acrylate, butyl acrylate, 2-ethylhexyl acrylate and dimethylaminoethyl acrylate; methacrylates such as methyl methacrylate, ethyl methacrylate, propyl methacrylate, butyl methacrylate, 2-ethylhexyl methacrylate and dimethylaminoethyl methacrylate; acrylic acid derivatives and methacrylic acid derivatives such as acrylonitrile, methacrylonitrile, acrylamide and methacrylamide; olefins such as ethylene, propylene and butylene; vinyl halides and vinylidene halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone.

These monovinyl monomers may be used either singly or in any combination thereof. Of these, the styrene, styrene derivatives and the derivatives of acrylic acid or methacrylic acid are preferably used.

The monovinyl monomer(s) may preferably be selected in such a manner that the glass transition temperature (Tg) of a polymer obtained by polymerizing them is 80° C. or lower. The monovinyl monomers are used singly in combination of 2 or more thereof, whereby the Tg of the polymer can be controlled within a desired range.

An optional crosslinkable monomer is preferably used as a polymerizable monomer together with the monovinyl monomer for the purpose of improving the hot offset resistance of the resulting toner. The crosslinkable monomer means a monomer having at least two polymerizable functional groups. As examples of the crosslinkable monomer, may be mentioned aromatic divinyl compounds such as divinylbenzene, divinylnaphthalene and derivatives thereof; unsaturated carboxylic acid esters of polyvalent alcohols, such as ethylene glycol dimethacrylate and diethylene glycol dimethacrylate; other divinyl compounds such as N,N-divinylaniline and divinyl ether; and compounds having three or more vinyl groups.

These crosslinkable monomers may be used either singly or in any combination thereof. In the present invention, the crosslinkable monomer is used in a proportion of generally 0.1 to 5 parts by weight, preferably 0.3 to 2 parts by weight per 100 parts by weight of the monovinyl monomer.

It is preferable to use a macromonomer as a polymerizable monomer together with the monovinyl monomer because a balance between the storage stability and the low-temperature fixing ability of the resulting polymerized toner can be improved. The macromonomer is a reactive oligomer or polymer having a polymerizable carbon-carbon unsaturated double bond at its molecular chain terminal. The number average molecular weight of the macromonomer is generally 1,000 to 30,000.

The macromonomer is preferably that giving a polymer having a glass transition temperature higher than that of a polymer obtained by polymerizing the monovinyl monomer. The amount of the macromonomer used is generally 0.01 to 10 parts by weight, preferably 0.03 to 5 parts by weight, more preferably 0.05 to 1 part by weight per 100 parts by weight of the monovinyl monomer.

Color toners generally include 4 color toners of black, cyan, yellow and magenta. Therefore, in the present invention, black, cyan, yellow and magenta colorants are used as colorants to produce color toners of the respective color tones.

As the black colorants, may be used colorants and dyes, such as carbon black, titanium black, oil black and magnetic powders such as zinc iron oxide and nickel iron oxide.

As the yellow colorants, may be used, for example, compounds such as azo colorants and fused polycyclic colorants. Specific examples thereof include C.I. Pigment Yellow 3, 12, 13, 14, 15, 17, 62, 65, 73, 74, 83, 90, 93, 97, 120, 138, 155, 180, 181, 185, 186 and 213. These colorants are used either singly or in combination of plural kinds of colorants thereof.

As the magenta colorants, may be used, for example, compounds such as azo colorants and polycyclic colorants. Specific examples thereof include C.I. Pigment Red 31, 48, 57, 58, 60, 63, 64, 68, 81, 83, 87, 88, 89, 90, 112, 114, 122, 123, 144, 146, 149, 150, 163, 170, 184, 185, 187, 202, 206, 207, 209 and 251, and C.I. Pigment Violet 19. These colorants are used either singly or in combination of plural kinds of colorants thereof.

As the cyan colorants, may be used, for example, copper phthalocyanine compounds and derivatives thereof, and anthraquinone compounds. Specific examples thereof include C.I. Pigment Blue 2, 3, 6, 15, 15:1, 15:2, 15:3, 15:4, 16, 17 and 60. These colorants are used either singly or in combination of plural kinds of colorants thereof.

The amount of the colorant used is generally 0.1 to 70 parts by weight, preferably 0.5 to 50 parts by weight, more preferably 1 to 10 parts by weight per 100 parts by weight of the monovinyl monomer.

In order to stabilize the dispersed state of the colorant in the polymerizable monomer, and adjust the initial viscosity of the polymerizable monomer mixture, it is preferable to add a pigment dispersant into the polymerizable monomer mixture. As the pigment dispersant, is preferred a coupling agent such as an aluminum coupling agent, silane coupling agent or titanium coupling agent. The pigment dispersant is used in a proportion of generally 0.05 to 3 parts by weight, preferably 0.1 to 2 parts by weight per 100 parts by weight of the monovinyl monomer. In order to efficiently conduct uniform dispersion, it is preferable to add the pigment dispersant prior to the preliminary dispersion step or in the course thereof when the preliminary dispersion step is conducted, or prior to the dispersion step or in the course thereof. It is more preferable to add it prior to the preliminary dispersion step. When no preliminary dispersion is conducted, it is preferable to add the pigment dispersant prior to the dispersion step.

In the present invention, a charge control agent is preferably used. As the charge control agent, may be used various kinds of charge control agents having positively charging ability or negatively charging ability. As the charge control agent, may be used, for example, charge control agents such as metal complexes of organic compounds having a carboxyl group or a nitrogen-containing group, metallized dyes and nigrosine; and charge control resins such as quaternary ammonium group-containing copolymers or salts thereof, and sulfonic group-containing copolymers or salts thereof. Among these, the charge control resins such as quaternary ammonium group-containing copolymers or salts thereof, and sulfonic group-containing copolymers or salts thereof are preferably used because the durability of the resulting toner is improved.

The charge control agent is used in a proportion of generally 0.01 to 10 parts by weight, preferably 0.03 to 8 parts by weight per 100 parts by weight of the monovinyl monomer.

The charge control agent is generally added to the dispersed polymerizable monomer mixture after the dispersion step using the media type dispersing machine. However, a part of the charged amount may also be added prior to the preliminary dispersion step or the dispersion step. In this case, the dispersion of the colorant can be stabilized like the pigment dispersant.

It is preferable to contain a molecular modifier in the polymerizable monomer mixture to prepare a polymerizable monomer composition. Examples of the molecular weight modifier include mercaptans such as t-dodecylmercaptan, n-dodecylmercaptan, n-octylmercaptan and 2,2,4,6,6-pentamethylheptane-4-thiol.

The molecular weight modifier may be added to the polymerizable monomer composition prior to the initiation of the polymerization or in the course of the polymerization. The amount of the molecular weight modifier used is preferably 0.01 to 10 parts by weight, more preferably 0.1 to 5 parts by weight per 100 parts by weight of the monovinyl monomer.

As another additive component, may preferably be used a mold lubricant. No particular limitation is imposed on the mold lubricant so far as it is that used as a mold lubricant for toner. Examples of the mold lubricant include low-molecular weight polyolefin waxes such as low-molecular weight polyethylene, low-molecular weight polypropylene and low-molecular weight polybutylene; terminal-modified polyolefin waxes such as molecule terminal-oxidized low-molecular weight polypropylene, terminal-modified low-molecular weight polypropylene with its molecular terminal substituted by an epoxy group and block polymers of these compounds with low-molecular weight polyethylene, and molecule terminal-oxidized low-molecular weight polyethylene, low-molecular weight polyethylene with its molecular terminal substituted by an epoxy group and block polymers of these compounds with low-molecular weight polypropylene; vegetable natural waxes such as candelilla wax, carnauba wax, rice wax, Japan wax and jojoba wax; petroleum waxes such as paraffin wax, microcrystalline wax and petrolatum, and modified waxes thereof; mineral waxes such as montan, ceresin and ozokerite; synthetic waxes such as Fischer-Tropsch wax; pentaerythritol esters such as pentaerythritol tetramyristate, pentaerythritol tetrapalmitate, pentaerythritol tetrastearate and pentaerythritol tetralaurate; and dipentaerythritol esters such as dipentaerythritol hexamyristate, dipentaerythritol hexapalmitate and dipentaerythritol hexalaurate. These mold lubricants may be used either singly or in any combination thereof.

The mold lubricant is used in a proportion of preferably 0.1 to 30 parts by weight, more preferably 1 to 20 parts by weight per 100 parts by weight of the monovinyl monomer.

1. Preparation Step of Polymerizable Monomer Mixture:

The first production process according to the present invention comprises Step 1 of mixing a polymerizable monomer with a colorant to prepare a polymerizable monomer mixture having an initial viscosity of 10 to 3,000 mPa·s as measured at 25° C. by a Brookfield type viscometer. In this Step 1, it is preferable that the mixture containing the polymerizable monomer and colorant is fed to another dispersing machine of the type that mechanical shearing force is given than the media type dispersing machine to preliminarily disperse the colorant by the dispersing machine, thereby preparing the polymerizable monomer mixture having an initial viscosity of 10 to 3,000 mPa·s as measured at 25° C. by the Brookfield type viscometer.

The second production process according to the present invention comprises Step I of mixing a polymerizable monomer with a colorant to prepare a polymerizable monomer mixture having an initial viscosity of 0.3 to 1 mPa·s as measured at 25° C. by a Brookfield type viscometer. In this Step I, it is preferable that the mixture containing the polymerizable monomer and colorant is fed to another dispersing machine of the type that mechanical shearing force is given than the media type dispersing machine to preliminarily disperse the colorant by the dispersing machine, thereby preparing the polymerizable monomer mixture having an initial viscosity of 0.3 to 1 mPa·s as measured at 25° C. by the Brookfield type viscometer.

The above-described preliminary dispersion step is a step of dispersing the colorant in the polymerizable monomer in advance by the agitating device, which is different from the media type dispersing machine and has high shearing force, prior to a dispersion step making use of the media type dispersing machine. In the present invention, it is preferable to conduct the preliminary dispersion step because the dispersion step can be more stably conducted continuously with this step. In the preliminary dispersion step, the polymerizable monomer mixture containing the polymerizable monomer and colorant is preliminarily dispersed, and so this mixture may be referred to as "a preliminarily dispersed polymerizable monomer mixture". In the present invention, a mixture, which contains the polymerizable monomer and colorant, and in which the colorant is not dispersed, may be referred to as "a liquid mixture containing the polymerizable monomer and colorant".

In preliminary dispersion step, mechanical shearing force is applied to the colorant in the liquid mixture containing the polymerizable monomer and colorant to conduct preliminary dispersion. As a pre-dispersing machine, is preferably used an agitating device having high shearing force. Examples of the pre-dispersing machine include dispersing machines of the type that mechanical shearing force is given by a rotor, dispersing machines of the type that mechanical shearing force is given by a turbine and dispersing machines of the type that mechanical shearing force is given by centrifugal force and an agitator.

More specifically, examples of the dispersing machine having high shearing force include devices that is equipped with comb teeth-like rotor and a stator which are concentrically arranged, the rotor is rotated at high speed, and a liquid to be agitated is passed through from the internal side of the rotor to the external side of the stator to agitate the liquid dispersion between the rotor and the stator, such as Ebara Milder (manufactured by Ebara Corporation, trademark), CAVITRON (manufactured by EUROTEC, LTD, trademark) and DRS2000 (manufactured by IKA Co., trade name); devices that agitation is conducted by action of shearing force, impact force, pressure change, cavitation and potential core caused between a rotor, which is rotated at high speed, and a screen surrounding it, such as CLEARMIX CLM-0.8S (manufactured by M-TECHNIQUE Co., Ltd., trademark); turbine type agitating machines such as TK Homomixer (manufactured by Tokushu Kika Kogyo Co., Ltd., trade name); and devices that a liquid to be treated is pressed against a side wall of a dispersing chamber by centrifugal force to form a liquid film, and a tip of an agitator rotating at ultra-high speed is brought into contact with the liquid film, thereby conducting agitation, such as TK Filmix (manufactured by Tokushu Kika Kogyo Co., Ltd., trade name).

In the dispersing machine of the type that mechanical shearing force is given by a rotor, the peripheral speed of the tip of the rotor is controlled within a range of 15 to 60 m/sec, preferably 17 to 55 m/sec, more preferably 20 to 50 m/sec. If the peripheral speed of the tip of the rotor exceeds the above range, the temperature of the polymerizable monomer mixture is raised to cause a polymerization reaction to partially progress. As a result, the fixing ability of the resulting polymerized toner is deteriorated, and no polymerized toner having stable properties can be provided every polymerization lot.

When the preliminary dispersion is conducted by the pre-dispersing machine, it is preferable to conduct the preliminary dispersion while suppressing a range of temperature rise from a liquid temperature prior to the preliminary dispersion to the liquid temperature after the preliminary dispersion to 30° C. or lower, preferably 20° C. or lower by forced cooling for the purpose of preventing the temperature of the polymerizable monomer mixture, which is being subjected to the preliminary dispersion by heat generation by shearing, from rising.

In the first production process according to the present invention, preferably, the preliminary dispersion step is arranged in the preparation step of the polymerizable monomer mixture, thereby preparing a polymerizable monomer mixture having an initial viscosity of 10 to 3,000 mPa·s as measured at 25° C. by the Brookfield type viscometer. The initial viscosity of the polymerizable monomer mixture (preliminarily dispersed polymerizable monomer mixture) is controlled within a range of preferably 10 to 2,000 mPa·s, more preferably 100 to 1,500 mPa·s, particularly preferably 150 to 1,000 mPa·s.

In the second production process according to the present invention, preferably, the preliminary dispersion step is arranged in the preparation step of the polymerizable monomer mixture, thereby preparing a polymerizable monomer mixture having an initial viscosity of 0.3 to 1 mPa·s as measured at 25° C. by the Brookfield type viscometer. The initial viscosity of the polymerizable monomer mixture (preliminarily dispersed polymerizable monomer mixture) is controlled within a range of preferably 0.3 to 0.9 mPa·s, more preferably 0.4 to 0.8 mPa·s, particularly preferably 0.5 to 0.8 mPa·s.

The colorants used as a raw material may include those containing coarse particles in plenty or those having a too great average particle diameter. More specifically, a volume percent occupied by particles having a particle diameter of 51 μm or greater in the colorant used as a starting material is generally higher than 30%, but not higher than 95%. A volume average particle diameter of the colorant used as the starting material is generally greater than 30 μm, but not greater than 100 μm.

In such a case, in the first and second production processes according to the present invention, it is desirable to prepare a polymerizable monomer mixture (preliminarily dispersed polymerizable monomer mixture) containing a colorant, the volume percent occupied by particles having a particle diameter of 51 μm or greater in which is preferably 0 to 40%, more preferably 0 to 30%, by the preliminary dispersion. If coarse colorant particles are present in plenty in the polymerizable monomer mixture (preliminarily dispersed polymerizable monomer mixture), clogging is easy to occur in a separation part such as a media-separating screen of the media type dispersing machine. It is particularly preferable from the viewpoint of the prevention of clogging to control the volume percent occupied by particles having a particle diameter of 51 μm or greater in the colorant to lower than 20% by the preliminary dispersion.

In the first and second production processes according to the present invention, it is preferable to prepare a polymerizable monomer mixture (preliminarily dispersed polymerizable monomer mixture) containing a colorant having a volume average particle diameter of 30 μm or smaller. If colorant particles having a too great volume average particle diameter are present in the polymerizable monomer mixture (preliminarily dispersed polymerizable monomer mixture), clogging is easy to occur in a separation part such as a media-separating screen of the media type dispersing machine, and dispersing efficiency by the media type dispersing machine is lowered. It is particularly preferable from the viewpoint of the prevention of clogging to control the volume average particle diameter of the colorant to lower than 20 μm.

In the preliminary dispersion step, such various kinds of pre-dispersing machines as described above are used. An exemplary preliminary dispersion system is illustrated in FIG. 1. The preliminary dispersion system is a system comprising a holding tank 101 for storing a liquid mixture containing a polymerizable monomer and a colorant, a pre-dispersing machine 109, a circulation line 107 for circulating the liquid polymerizable monomer mixture between the holding tank 101 and the pre-dispersing machine 109, and a valve 111 arranged in a circulation line 112 between a discharge side of the pre-dispersing machine 109 and the holding tank 101.

An agitating blade 102 driven and rotated by an agitating motor 103 is arranged in the holding tank 101. A jacket 104 is fitted to an outer wall of the holding tank 101 in such a manner that the temperature of the liquid in the holding tank 101 can be controlled by introducing a temperature control medium into the jacket from an inlet 105 for the temperature control medium and discharging the medium from an outlet 106 for the temperature control medium.

The liquid mixture 113 containing the polymerizable monomer and colorant is poured into the holding tank 101. The liquid mixture is fed to the pre-dispersing machine 109 through the circulation line 107 by a pump 108. When the liquid mixture can be circulated by driving the pre-dispersing machine 109, it is not always necessary to feed the liquid mixture by the pump 108. In the pre-dispersing machine, an agitating blade is driven by a motor 110. The liquid mixture preliminarily dispersed by the pre-dispersing machine is circulated to the original holding tank 101 through the circulation line 112, in which the valve 111 has been arranged.

In the present invention, mechanical shearing force is applied to the colorant in the polymerizable monomer mixture (liquid mixture) in the preliminary dispersion step to preliminarily disperse the colorant. As the pre-dispersing machine, is preferably an agitating machine having high shearing force. In general, no particular limitation is imposed on the machine so far as it is a device that the liquid mixture is taken in a treating part, and an agitating blade provided in the treating part is rotated at high speed to disperse the colorant. No particular limitation is also imposed on the shape and structure of the agitating blade (rotor) so far as high shearing force can be applied to the liquid mixture.

The passing time in the pre-dispersing machine can be calculated out in accordance with the following equation.

Passing time (min)=[Space volume (L) of the pre-dispersing machine]/[Rate (L/min) of the liquid treated per unit time]

An average passing time is a value obtained by dividing the space volume of the pre-dispersing machine by an average value of the rate of the liquid treated per unit time. The rate of the liquid treated is calculated out by dividing a feed rate (kg/min) of the liquid mixture by a density of the liquid mixture. In Examples of the present invention, the density of the liquid mixture is determined to be 0.9 (kg/L).

The passing time is controlled within the above range, whereby the preliminary dispersion of the colorant can be sufficiently and efficiently conducted.

The preliminary dispersion of the liquid mixture containing the polymerizable monomer and colorant is preferably conducted by utilizing the preliminary dispersion system illustrated in FIG. 1 and circulating the liquid polymerizable monomer mixture at least twice in the pre-dispersing machine. The number of circulations can be calculated out in accordance with the following equation.

The number of circulations, θ (times)=[Treatment time (min)]/[Time *t* (min/time) required for one circulation]

The time t required for one circulation is determined in accordance with the following equation.

$$t=W/V$$

wherein t: the time (min/time) required for one circulation,

W: the amount (kg) of the liquid mixture poured into the holding tank,

V: the flow rate (kg/min) of the liquid mixture to be treated.

The number of circulations in the preliminary dispersion step can be suitably selected according to the size of the pre-dispersing machine used, the kind of the colorant, the volume of the liquid mixture and the like. However, the number of circulations is preferably 2 to 30 times.

When the preliminary dispersion is conducted in the present invention, it is preferable to operate the pre-dispersing machine with the internal pressure thereof raised for the purpose of preventing cavitation by high-speed agitation. As described above, the shearing force applied to the colorant is lowered when the cavitation occurs, so that the dispersing efficiency is worsened. As a means for raising the internal pressure of the pre-dispersing machine, for example, in such a system shown in FIG. 1, the internal pressure of the pre-dispersing machine 109 can be controlled by regulating the valve 111 located on the discharge side of the pre-dispersing machine 109 in the circulation line 112. The internal pressure of the pre-dispersing machine is controlled within a range of preferably 0.01 to 15 MPa, more preferably 0.05 to 10 MPa, particularly preferably 0.1 to 5 MPa.

When the liquid mixture is subjected to preliminary dispersion by means of, for example, a turbine type agitating machine such as TK Homomixer in place of the in-line type pre-dispersing machine, the treatment time is controlled to generally 1 to 60 minutes, preferably 5 to 30 minutes.

2. Dispersion Step by Media Type Dispersing Machine:

In the dispersion step using the media type dispersing machine, as a polymerizable monomer mixture, is used the polymerizable monomer mixture in the case where no preliminary dispersion step is conducted in the preparation step of the polymerizable monomer mixture, or the preliminarily dispersed polymerizable monomer mixture in the case where the preliminary dispersion step has been conducted. Since the colorant used as a raw material often contains coarse particles in plenty or has a too great average particle diameter, "the preliminarily dispersed polymerizable monomer mixture" obtained by subjecting the liquid mixture containing the polymerizable monomer and colorant to the preliminary dispersion is generally used. In the dispersion step, this polymerizable monomer mixture is fed to a media type dispersing machine to more finely disperse the colorant by the media type dispersing machine. The polymerizable monomer mixture obtained in the dispersion step is referred to as "the dispersed polymerizable monomer mixture".

In the dispersion step 2 in the first production process according to the present invention, the polymerizable monomer mixture having an initial viscosity of 10 to 3,000 mPa·s is fed to the media type dispersing machine to finely disperse the colorant by the media type dispersing machine.

In the dispersion step II in the second production process according to the present invention, the polymerizable monomer mixture having an initial viscosity of 0.3 to 1 mPa·s is fed to the media type dispersing machine to finely disperse the colorant by the media type dispersing machine.

The initial viscosity of the polymerizable monomer mixture means a viscosity of the polymerizable monomer mixture before the polymerizable monomer mixture is fed to the media type dispersing machine. The initial viscosity of the polymerizable monomer mixture may be controlled by, for example, a combination of selection of the kind of the colorant as a raw material, control of the amount of the colorant added, addition of a pigment dispersant, and the like. However, it is preferable to adopt a method that the preliminary dispersion step is arranged, thereby controlling the initial viscosity to a desired viscosity. A preliminarily dispersed polymerizable monomer mixture containing a colorant, in which the volume percent of particles having a particle diameter of 51 μm or greater is 0 to 30%, and/or having a volume average particle diameter of 30 μm or smaller, which has been prepared by arranging the preliminary dispersion step, is preferably fed to the media type dispersing machine in that clogging in a separation part such as a media-separating screen of the media type dispersing machine is prevent to stably operate the dispersion step.

The preliminarily dispersed polymerizable monomer mixture with the colorant uniformly and finely dispersed therein is prepared by conducting the preliminary dispersion in such a manner, and the preliminarily dispersed polymerizable monomer mixture is extremely finely dispersed by the media type dispersing machine, whereby the dispersion step can be stably and efficiently conducted. The preliminarily dispersed polymerizable monomer mixture is fed to the media type dispersing machine, whereby aggregate of the colorant is hard to accumulate in the media type dispersing machine, so that the media type dispersing machine can be continuously operated without disassembling the dispersing machine to clean the interior of a casing.

In the first production process according to the present invention, in the dispersion step 2, the polymerizable monomer mixture having an initial viscosity of 10 to 3,000 mPa·s is fed to the media type dispersing machine to finely disperse the colorant by the media type dispersing machine, thereby preparing a dispersed polymerizable monomer mixture having a viscosity after the dispersion, the ratio of increase in viscosity of which is 1.0 to 10 times as high as the initial viscosity. In the first production process, the ratio of increase in viscosity is preferably 1.0 to 9.9 times, more preferably 1.0 to 9.5 times, particularly preferably 1.0 to 9.0 times.

In the second production process according to the present invention, in the dispersion step II, the polymerizable monomer mixture having an initial viscosity of 0.3 to 1 mPa·s is fed to the media type dispersing machine to finely disperse the colorant by the media type dispersing machine, thereby preparing a dispersed polymerizable monomer mixture having a viscosity after the dispersion, the ratio of increase in viscosity of which is 100 to 2,000 times as high as the initial viscosity. In the second production process, the ratio of increase in viscosity is preferably 130 to 1,500 times, particularly preferably 150 to 1,000 times.

In the present invention, as described above, the ratio of increase in viscosity is controlled low when the polymerizable monomer mixture having a relatively high initial viscosity is dispersed by the media type dispersing machine (first production process). On the other hand, when the polymerizable monomer mixture having a low initial viscosity is dispersed by the media type dispersing machine (second production process), such dispersion conditions as the ratio of increase in viscosity increases are adopted. Such a dispersion step is arranged, whereby the colorant can be uniformly and finely dispersed in the polymerizable monomer mixture, and the dispersion step can be stably and efficiently carried out.

If a polymerizable monomer mixture (preliminarily dispersed polymerizable monomer mixture) having an initial viscosity lower than 10 mPa·s is dispersed by the media type dispersing machine in the first production process of the present invention, the image density of the resulting toner is lowered even when the ratio of increase in viscosity of the dispersed polymerizable monomer mixture is controlled within the range of 0.1 to 10 times. In addition, if a polymerizable monomer mixture having an initial viscosity of 100 to 3,000 mPa·s is dispersed by the media type dispersing machine in the first production process of the present invention to control the ratio of increase in viscosity after the dispersion to higher than 10 times, the stability to continuous operation in the dispersion step is lowered, and moreover the image density of the resulting toner is lowered. Further, if a polymerizable monomer mixture having a low initial viscosity is dispersed by the media type dispersing machine in the first production process to prepare a dispersed polymerizable monomer mixture the percentage of increase in viscosity of which is too high, the stability to continuous operation in the dispersion step is markedly impeded.

If a polymerizable monomer mixture having an initial viscosity higher than 1 mPa·s (higher than 1 mPa·s, but lower than 10 mPa·s) dispersed by the media type dispersing machine in the second production process of the present invention to control the ratio of increase in viscosity after the dispersion within a range of 100 to 2,000 times, the stability to continuous operation in the dispersion step is impeded, and moreover a proportion of the polymerizable monomer mixture remaining in the media type dispersing machine is increased. If a polymerizable monomer mixture having an initial viscosity higher than 1 mPa·s (higher than 1 mPa·s, but lower than 10 mPa·s) dispersed by the media type dispersing machine in the second production process, the image density of the resulting toner is lowered when the ratio of increase in viscosity after the dispersion is suppressed.

In order to control the ratio of increase in viscosity within the above range, there can be adopted, for example, a method in which the number of circulations in the media type dispersing machine used in the dispersion step and operation conditions thereof are controlled, or the particle diameter of media particles contained in the media type dispersing machine is controlled within a specified range, or the initial viscosity is controlled by the above-described method.

The viscosity (initial viscosity and viscosity after the dispersion) in the present invention is a value measured by means of a Brookfield type viscometer (manufactured by Brookfield Co., model name "Digital-Rheometer DV-I+"). After the temperature of a sample is adjusted to 25° C. using a constant-temperature water bath, a spindle is rotated for 1 minute at a spindle speed of 60 rpm by the Brookfield type viscometer, and a viscosity is then measured. As the spindle, the following grade number is used according to the range of viscosity to be measured of the sample.

Lower than 100 mPa·s: Spindle No. 1,

Not lower than 100 mPa·s, but lower than 200 mPa·s: Spindle No. 2,

Not lower than 200 mPa·s: Spindle No. 3.

Figure 2:
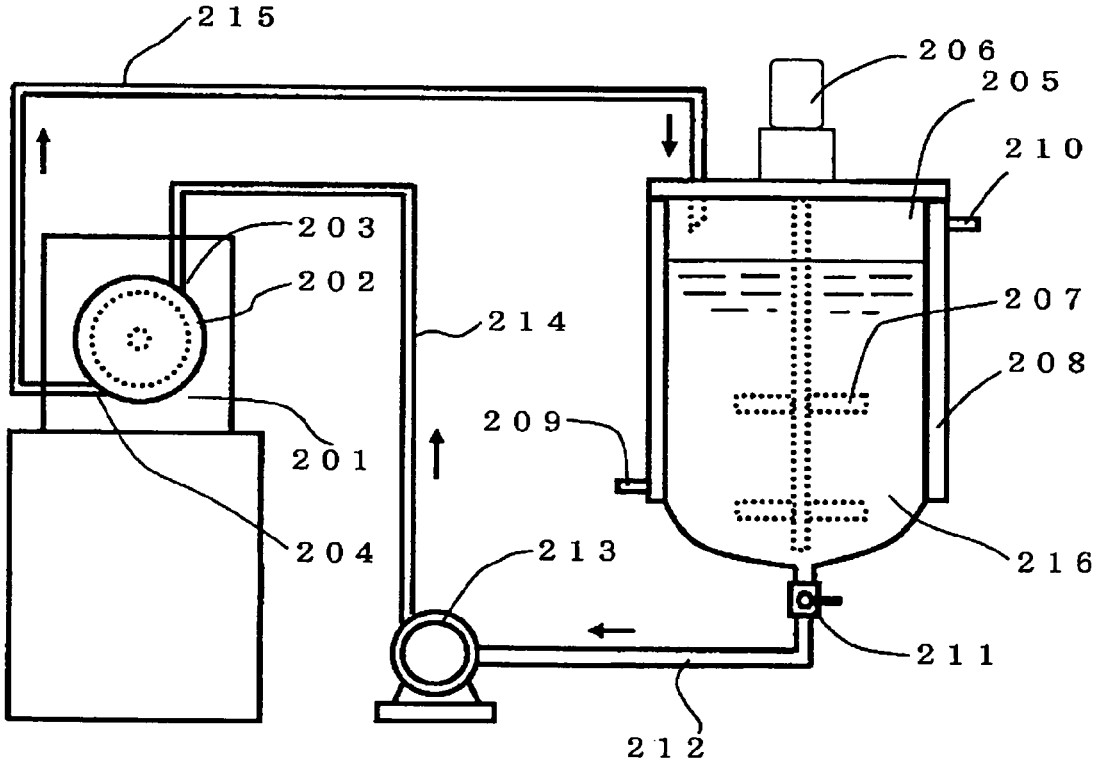
FIG. 2 illustrates a dispersion system adopted in Examples of the present invention.

In the disperse step (Step 2 or Step II) using the media type dispersing machine in the present invention, it is preferable to use a media type dispersing machine equipped with a media-separating screen. An exemplary dispersion system using the media type dispersing machine is illustrated in FIG. 2. The dispersion system shown in FIG. 2 comprises a media type dispersing machine 201 and a holding tank 205, which are connected to each other by a downward flow composed of lines 212 and 214 and an upward flow composed of a line 215. The holding tank 101 used in the preliminary disperse step may be used as the holding tank 205, and any other holding tank may also be used.

An agitating blade 207 driven and rotated by an agitating motor 206 is arranged in the holding tank 205. A jacket 208 is fitted to an outer wall of the holding tank 205 in such a manner that the temperature of a liquid in the holding tank 205 can be controlled to a desired temperature by introducing a temperature control medium into the jacket from an inlet 209 for the temperature control medium and discharging the medium from an outlet 210 for the temperature control medium.

A liquid mixture containing a polymerizable monomer and a colorant is poured into the holding tank 205 and agitated. The liquid mixture is generally a preliminarily dispersed polymerizable monomer mixture containing the colorant preliminarily dispersed in the preliminary dispersion step. The liquid mixture within the holding tank 205 is introduced into a casing (also referred to as "container" or "stator") 202 from a liquid inlet 203 of the media type dispersing machine 201 through a valve 211, the line 212, a circulating pump 213 and the line 214 by driving the circulating pump 213.

The liquid mixture is subjected to strong shearing force within the media type dispersing machine 201 to finely pulverize and disperse the colorant therein. The liquid polymerizable monomer dispersion with the colorant finely dispersed therein is introduced into the holding tank 205 from a liquid outlet 204 through the line 215. The liquid polymerizable monomer dispersion passed through the media type dispersing machine once may be circulated in the same media type dispersing machine 201 again the desired number of times for the purpose of achieving more uniform and fine dispersion of the colorant.

The polymerizable monomer tends to initiate partial polymerization when it is heated to a high temperature. When the viscosity of the liquid mixture or dispersion is too high on the other hand, the flowability thereof in the dispersion system is lowered. It is thus desirable to make temperature control by passing a temperature control medium such as cold water or hot water through the jacket 208 in such a manner the temperature of the liquid in the holding tank 205 is controlled within a range of, for example, 30° C. or lower, preferably 20° C. or lower, often 10 to 30° C.

Likewise, when the liquid mixture or dispersion is subjected to strong shearing force within the media type dispersing machine, the temperature of the liquid mixture or dispersion is raised, and the polymerizable monomer tends to undergo partial polymerization. It is thus desirable to control the temperature of the liquid mixture within a range of about 10 to 30° C. by passing a cooling medium such as cooling water through a jacket of the media type dispersing machine.

Figure 3:
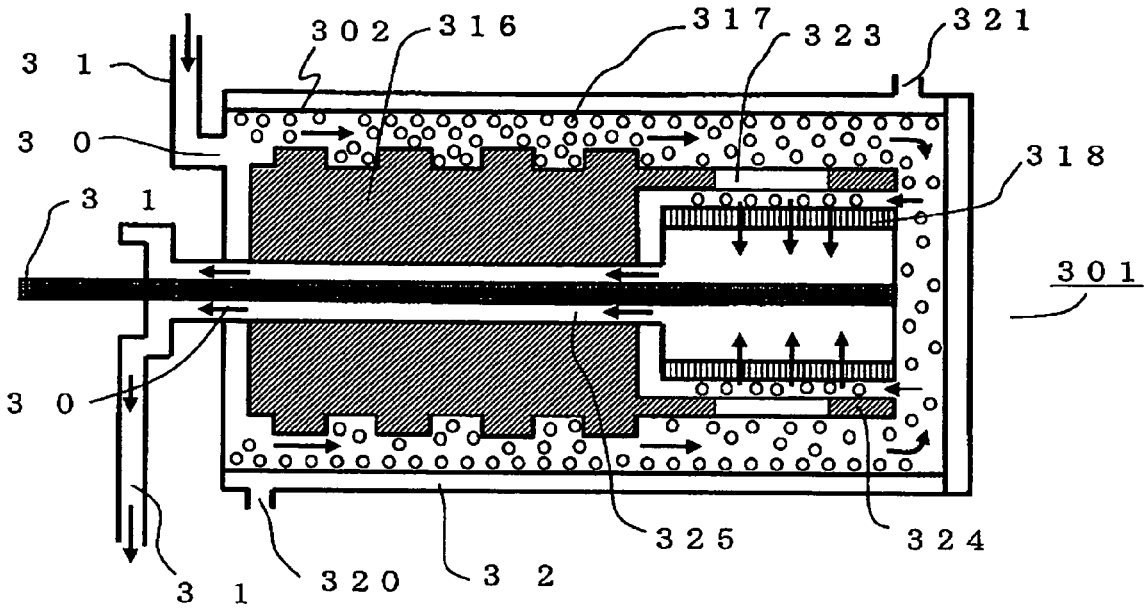
FIG. 3 is a cross-sectional view illustrating an exemplary media type dispersing machine used in the present invention.

FIG. 3 is a cross-sectional view illustrating an exemplary media type dispersing machine used in the present invention. This media type dispersing machine 301 has a structure that a driving shaft 319, and a rotor 316 and a media-separating screen 318, which are arranged on the driving shaft 319 and can be rotated simultaneously in cooperation with the rotation of the driving shaft 319, are provided within a casing 302 having a liquid inlet 303 and a liquid outlet 304.

An internal space defined between an inner wall of the casing 302 and an outer wall of the rotor 316 serves as a dispersing chamber containing media particles 317. At one end of the rotor 316, is provided a cylindrical part 324 in which a plurality of media particle-discharging slits 323 are formed. The media-separating screen 318 is arranged within this cylindrical part 324. A liquid introduced into the casing 302 from the liquid inlet 303 passes through the media-separating screen 318 and discharges out of the liquid outlet 304 through a liquid discharge path 325. The liquid discharge path 325 is provided, for example, between the driving shaft 319 and the rotor 316. The liquid discharge path 325 may also be formed in the rotor 316.

When the driving shaft 319 is rotated by a motor (not illustrated) installed in the media type dispersing machine, the rotor 316 and media-separating screen 318 arranged on the driving shaft 319 are rotated at the same time. The liquid mixture containing the polymerizable monomer and colorant is continuously fed into the casing 302 through the liquid inlet 303 from a line 314, strong shearing force is applied to the liquid mixture by centrifugal force generated by the rotation of the rotor 316 and the action of the media particles 317, whereby the colorant is finely dispersed in the polymerizable monomer.

The liquid polymerizable monomer dispersion with the colorant finely dispersed therein is passed through the media-separating screen 318 and discharged out of the liquid outlet 304 through the liquid discharge path 325. When this liquid polymerizable monomer dispersion is returned back to the holding tank 205 through a line 315 and circulated in the same media type dispersing machine again, a liquid dispersion (dispersed polymerizable monomer mixture) with the colorant more uniformly and finely dispersed therein can be obtained.

In the dispersion system shown in FIG. 2, the circulating pump 213 is driven to continuously feed the liquid mixture or dispersion to the media type dispersing machine, so that the liquid polymerizable monomer dispersion with the colorant finely dispersed therein is passed through the media-separating screen 318 and continuously discharged from the liquid outlet 304 to the outside (for example, the interior of the holding tank) by discharge pressure of the circulating pump 213. The media-separating screen 318 is equipped with a lattice- or mesh-like screen. Since the media particles 317 used are greater than the mesh size or lattice space of the media-separating screen 318, they do not pass through the media-separating screen.

Figure 4:
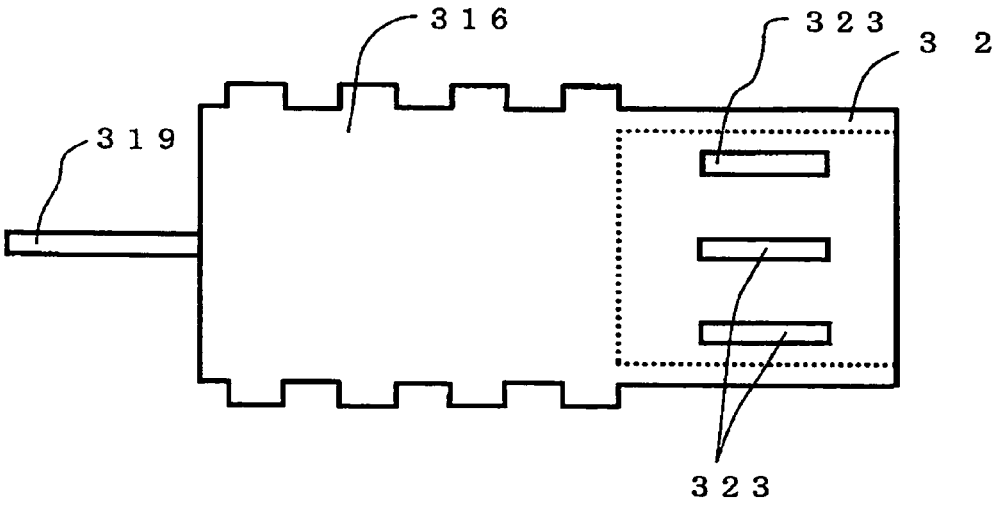
FIG. 4 illustrates a rotor used in the media type dispersing machine.

Since the media-separating screen is arranged on the driving shaft 319 and rotated in cooperation with the rotation of the driving shaft 319, the overall shape thereof is generally cylindrical. In other words, an outer periphery of the cylinder is formed by a screen, one end of the cylinder is closed, and an opening communicating with the liquid discharge path 325 is formed at the other end. As illustrated in FIGS. 3 and 4, the rotor 316 is provided with the cylindrical part 324, in which a plurality of media particle-discharging slits 323 are formed, at one end thereof. The media-separating screen is arranged within this cylindrical part.

The size of each slit 323 is regulated to such an extent that the media particles can be passed through. During the dispersing treatment, the liquid polymerizable monomer dispersion with the colorant finely dispersed therein reaches the surface of the media-separating screen 318 together with the media particles 317, the media particles 317 are returned to the dispersing chamber through the slits 323 formed in the cylindrical part 324 by virtue of the centrifugal force of the rotating media-separating screen, and only the liquid polymerizable monomer dispersion is discharged from the liquid outlet 304 to the outside.

Accordingly, this media type dispersing machine can prevent uneven distribution such as remaining of the media particles 317 on the surface of the media-separating screen 318. In other words, the media type dispersing machine is excellent in media-separating ability in the media-separating part to prevent the media-separating part from causing clogging during the dispersing treatment to raise the internal pressure. When the internal pressure of the media type dispersing machine rises during the dispersing treatment, it is necessary to stop its operation or relax operation conditions. Since this media type dispersing machine is excellent in media-separating ability, however, the operation can be efficiently conducted to prevent the dispersing efficiency from lowering.

The media type dispersing machine used in the present invention is preferably composed of a material having a Rockwell scale C hardness (HRC) of 20 or higher at portions of the rotor and casing, with which the liquid mixture or dispersion comes into contact. The Rockwell scale C hardness (HRC) is determined to be 20 or higher, whereby abrasion caused by sliding friction between the rotor and casing, and the media particles 317 contained in the internal space can be prevented, and in turn, the liquid polymerizable monomer dispersion can be prevented from contaminating with contaminants produced by the abrasion.

The peripheral speed of the tip of the rotor in the media type dispersing machine is preferably at least 2 m/sec, more preferably at least 4 m/sec, particularly preferably at least 8 m/sec. The peripheral speed is made high, whereby the dispersion of the colorant can be efficiently performed in a short period of time.

The rotor may be formed from, for example, a high-hardness ceramic such as zircon or zirconia, a high-hardness metal such as steel, or a high-molecular material such as a ultrahigh-molecular weight polyethylene or nylon.

The media particles may be made of, for example, a high-hardness ceramic such as zircon or zirconia, or a high-hardness metal such as steel. The media particles are generally spherical particles. The particle size (diameter) of the media particles is controlled to preferably 2 mm or smaller, more preferably 1 mm or smaller, further, preferably 0.05 to 0.5 mm, particularly preferably 0.05 to 0.4 mm, most preferably 0.08 to 0.35 mm from the viewpoint of the fine dispersibility of the colorant.

The apparent filling factor of the media particles packed in the media type dispersing machine is preferably 60 to 95% by volume, more preferably 70 to 90% by volume based on the internal space of the casing. The filling factor of the media particles is enhanced, whereby the colorant can be pulverized and dispersed with good efficiency to prevent short pass of the liquid mixture or dispersion in the dispersing chamber.

Among additive components for toner, a colorant such as a pigment is a component most difficult to be finely pulverized and dispersed, and other additive components such as a mold lubricant and a charge control agent are relatively easy to be dispersed or dissolved in the polymerizable monomer. Therefore, it is preferable from the viewpoint of efficiency of the dispersing treatment to subject a liquid mixture composed of a polymerizable monomer and a colorant to a dispersing treatment using the media type dispersing machine after the preliminary dispersion and cause the other additive components to contain after completion of the dispersion step.

In other words, when the dispersing treatment is conducted with the liquid mixture composed substantially of the polymerizable monomer and colorant without adding other additive components than the colorant, the colorant can be finely dispersed with good efficiency in a short period of time by means of a pre-dispersing machine and a holding tank each having a relatively small capacity, and a small-sized media type dispersing machine.

When the dispersion is conducted by means of the media type dispersing machine, the dispersing treatment is generally conducted by feeding the liquid mixture within the holding tank 205 into the media type dispersing machine 201. The liquid mixture (polymerizable monomer mixture) containing the polymerizable monomer and colorant is passed through the media type dispersing machine 201 at least once. When the number of times of passing through the media type dispersing machine is one time, the number of circulations is indicated as one time.

In order to achieve sufficient dispersion of the colorant, it is preferable that the liquid dispersion subjected to the dispersing treatment once be fed to the media type dispersing machine again and circulated at least twice to conduct the dispersing treatment. The number (O) of circulations can be calculated out in accordance with the following equation.

The number of circulations, θ (times)=[Treatment time (min)]/[Time (min/time) required for one circulation]

The time (t) required for one circulation is determined in accordance with the following equation.

$$t=W/V$$

wherein t: the time (min/time) required for one circulation,

W: the amount (kg) of the liquid mixture poured into the holding tank,

V: the rate (kg/min) of the liquid fed by the circulating pump.

The number of circulations in the dispersion step can be suitably selected according to the size of the media type dispersing machine used, the kind of the colorant, the volume of the liquid to be treated and the like. However, the number of circulations is of the order of generally 1 to 30 times, preferably 2 to 30 times, more preferably 3 to 20 times, particularly preferably 3 to 10 times.

In the present invention, a treating rate in the media type dispersing machine means the rate (kg/min) of the circulating pump. Specifically, this rate (kg/min) of the liquid mixture fed by the circulating pump means a feed rate (kg/min) of the liquid mixture from the holding tank 205 to the media type dispersing machine 201.

In the present invention, the passing time of the liquid mixture in the media type dispersing machine can be calculated out in accordance with the following equation.

Passing time (min)=[Space volume (L) of the media type dispersing machine]/[Rate (L/min) of the liquid treated per unit time]

An average passing time is a value obtained by dividing the space volume of the media type dispersing machine by an average value of the rate of the liquid treated per unit time. The rate of the liquid treated is calculated out by dividing a feed rate (kg/min) of the liquid mixture by a density of the liquid mixture. In Examples of the present invention, the density of the liquid mixture is determined to be 0.9 (kg/L). In the first production process of the present invention, the passing time of the liquid mixture in the media type dispersing machine may be preferably 0.4 to 1.5 minutes.

As another system than such circulation system as described above, may also be used a system by a one-pass system that a polymerizable monomer mixture subjected to dispersion by the media type dispersing machine is not returned to the original holding tank, but introduced into another tank.

The media type dispersing machine used in the present invention is generally a dispersing machine having a structure that a rotor is rotationally arranged within a stator, and media are filled into a space defined between the stator and the rotor and moved by the rotating rotor. Media type dispersing machines include types of, for example, horizontal cylinder system, vertical cylinder system and inverse triangle system. As examples of commercially available products of the media type dispersing machines, may be mentioned Attritor (manufactured by Mitsui Miike Engineering Corporation, trade name), Maiti Mill (manufactured by INOUE MFG., INC., trade name), Diamond Fine Mill (manufactured by Mitsubishi Heavy Industries, Ltd., trade name), Dyno Mill (manufactured by Shinmaru Enterprises Corporation, trade name), Pico Mill (manufactured by Asada Iron Works Co., Ltd., trade name), Star Mill (manufactured by Ashizawa Finetech Ltd., trade name) and Apex Mill (manufactured by Kotobuki Engineering & Manufacturing Co., Ltd., trade name).

Among the above-described types, the dispersing machine of the horizontal cylinder system is preferred because good dispersion can be achieved while controlling changes in viscosity. A media type dispersing machine having a media-separating screen is more preferably used because it has good media-separating ability. There is still more preferably used a media type dispersing machine (see FIG. 3) so constructed that a driving shaft, and a rotor and a media-separating screen, which are arranged on the driving shaft and can be rotated simultaneously in cooperation with the rotation of the driving shaft, are provided within a cylindrical casing, a cylindrical part, in which a plurality of media particle-discharging slits are formed, is provided at one end of the rotor, the media-separating screen is arranged within this cylindrical part, and a liquid introduced into the casing from a liquid inlet passes through the media-separating screen and discharges out of a liquid outlet, and has a characteristic media-separating screen with media particles contained in an internal space defined between the inner surface of the casing and the outer surface of the rotor.

The media type dispersing machine having the media-separating screen can prevent uneven distribution such as remaining of the media particles 317 on the surface of the media-separating screen 318. In other words, the media type dispersing machine is excellent in media-separating ability in the media-separating part to prevent the media-separating part from causing clogging during the dispersing treatment to raise the internal pressure. When the internal pressure of the media type dispersing machine rises during the dispersing treatment, it is necessary to stop its operation or relax operation conditions. Since this media type dispersing machine is excellent in media-separating ability, however, the operation can be efficiently conducted to prevent the dispersing efficiency from lowering.

The polymerizable monomer contained in the polymerizable monomer mixture is easy to initiate partial polymerization when it is heated to a high temperature. On the other hand, when the temperature of the monomer mixture subjected to the dispersion is too low, and so its viscosity increases, the flowability thereof in the dispersion system is lowered. It is thus desirable to make temperature control by passing a temperature control medium such as cold water or hot water through the jacket 208 in such a manner the temperature of the liquid in the holding tank 205 falls within a range of 10 to 30° C. as described above. Likewise, when the liquid monomer mixture is subjected to strong shearing force within the media type dispersing machine, the temperature thereof is raised, and the polymerizable monomer tends to undergo partial polymerization. It is thus desirable to control the temperature of the liquid monomer mixture within a range of about 10 to 30° C. by passing a cooling medium such as cooling water through a jacket 322 of the media type dispersing machine 301. The cooling medium is introduced into the jacket 322 from an inlet 320 and discharged out of an outlet 321.

3. Polymerizable Monomer Composition:

In the dispersion step, is obtained a dispersed polymerizable monomer mixture with the colorant contained in the polymerizable monomer mixture (preliminarily dispersed polymerizable monomer mixture) more finely and uniformly dispersed therein.

The dispersed polymerizable monomer mixture obtained by the dispersion step contains at least the polymerizable monomer and colorant. This dispersed polymerizable monomer mixture may be used as a polymerizable monomer composition as it is. However, other additives such as a charge control agent, a mold lubricant, a molecular weight modifier and a pigment dispersant are generally added to prepare "a polymerizable monomer composition". As the additive components, may be used those described above. Among the additive components for toner, the charge control agent plays an important role for controlling the charging properties of the resulting toner and is preferably added as an essential component to the polymerizable monomer composition. An additional polymerizable monomer may also be added to the dispersed polymerizable monomer mixture.

4. Production of Polymerized Toner (Steps of Forming Droplets and Forming Colored Polymer):

The processes according to the present invention for producing a polymerized toner comprise the step of polymerizing the polymerizable monomer composition prepared by optionally adding the additive components for toner, such as a charge control agent, to the dispersed polymerizable monomer mixture obtained in the dispersion step using the media type dispersing machine in the presence of the polymerization initiator to form colored polymer particles. In the step of forming the colored polymer particles, a polymerization process such as a suspension polymerization process, dispersion polymerization process or emulsion polymerization process, in which the polymerizable monomer composition is polymerized in an aqueous dispersion medium, is adopted.

Among these processes, the suspension polymerization process and emulsion polymerization process are preferred, with the suspension polymerization process being particularly preferred.

The suspension polymerization process comprises a step of polymerizing a polymerizable monomer composition containing at least a colorant and a polymerizable monomer in an aqueous dispersion medium. As the aqueous dispersion medium, is generally used an aqueous dispersion medium containing a dispersion stabilizer. In the suspension polymerization process, the polymerizable monomer composition is first suspended in the aqueous dispersion medium containing the dispersion stabilizer to form fine droplets. This step may be referred to as a step of forming droplets of the polymerizable monomer composition. The polymerizable monomer composition dispersed as droplets in the aqueous dispersion medium is suspension-polymerized to form colored polymer particles. As needed, a step of additionally polymerizing a polymerizable monomer for shell in the presence of the colored polymer particles may be added to form core-shell type colored polymer particles.

Accordingly, the production processes according to the present invention comprise the step of polymerizing the polymerizable monomer composition containing at least the colorant and polymerizable monomer in the aqueous dispersion medium to form colored polymer particles, and if desired, additionally polymerizing a polymerizable monomer for shell in the presence of the colored polymer particles to form core-shell type colored polymer particles, thereby preparing an aqueous dispersion containing the colored polymer particles or core-shell type colored polymer particles.

In the emulsion polymerization process, may be adopted a process in which the polymerizable monomer composition containing the polymerizable monomer and colorant is first emulsion-polymerized in an aqueous dispersion medium containing an emulsifier, and the resultant colored fine resin particles are then aggregated and enlarged to a particle diameter suitable for toner.

Water such as ion-exchanged water is generally used as the aqueous dispersion medium. However, that obtained by adding a hydrophilic solvent such as alcohol to water may also be used. In the suspension polymerization process, the dispersion stabilizer is contained in the aqueous dispersion medium to increase the stability of droplets of the polymerizable monomer composition dispersed in the aqueous dispersion medium.

In the suspension polymerization process, a dispersion stabilizer such as colloid of a hardly water-soluble metal hydroxide is used. However, a surfactant may also be used in combination. In the emulsion polymerization process, various kinds of emulsifiers are added to the aqueous dispersion medium for the purpose of stabilizing the dispersion of the polymerizable monomer or polymerizable monomer composition.

Among these polymerization processes, the suspension polymerization process is preferred in that spherical colored polymer particles having a desired particle diameter are easy to be obtained, and core-shell type colored polymer particles are easy to be formed.

The dispersion stabilizer used in the present invention is preferably colloid of a hardly water-soluble metallic compound. As examples of the hardly water-soluble metallic compound, may be mentioned sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and ferric hydroxide. Among these, colloids of hardly water-soluble metal hydroxides are preferred because the particle diameter distribution of the polymer particles to be formed can be narrowed to improve the brightness of an image to be formed The colloid of the hardly water-soluble metallic compound is not limited by the production process thereof. However, it is preferred to use colloid of a hardly water-soluble metal hydroxide obtained by adjusting the pH of an aqueous solution of a water-soluble polyvalent metallic compound to 7 or higher, in particular, colloid of a hardly water-soluble metal hydroxide formed by reacting a water-soluble polyvalent metallic compound with an alkali metal hydroxide salt in an aqueous phase. The colloid of the hardly water-soluble metallic compound preferably has number particle diameter distributions, $D_{50}$ (50% cumulative value of number particle diameter distribution) of at most 0.5 μm and $D_{90}$ (90% cumulative value of number particle diameter distribution) of at most 1 μm.

The dispersion stabilizer is used in a proportion of generally 0.1 to 20 parts by weight per 100 parts by weight of the polymerizable monomer. If this proportion is too low, it is difficult to achieve sufficient polymerization stability, so that polymer aggregates are liable to form. If this proportion is too high, the viscosity of the aqueous solution becomes too high, and the polymerization stability is lowered.

In the present invention, a water-soluble polymer may be used as a dispersion stabilizer. As examples of the water-soluble polymer, may be mentioned polyvinyl alcohol, methyl cellulose and gelatin.

The dispersion stabilizers may be used either singly or in any combination thereof.

In the present invention, there is no need to use a surfactant. However, the surfactant may be used within limits not aggravating environmental dependency on charging properties of the resulting toner for stably conducting the suspension polymerization.

The polymerized toner is composed of colored polymer particles in which the polymer formed by the polymerization of the polymerizable monomer becomes a binder resin, and the additive components such as the colorant and mold lubricant are dispersed therein. As needed, the colored polymer particles may be used as core particles, and a shell formed of a polymer layer may be formed on the core particles to provide core-shell type colored polymer particles.

Taking the suspension polymerization process as an example, the polymerized toner can be obtained in accordance with, for example, the following process. The polymerizable monomer composition is dispersed in the aqueous dispersion medium containing the dispersion stabilizer, and the resultant dispersion is stirred to form uniform droplets of the polymerizable monomer composition. In the formation of the droplets of the polymerizable monomer composition, primary droplets having a volume average particle diameter of about 50 to 1,000 μm are first formed. In order to avoid premature polymerization, a polymerization initiator may be preferably added to the aqueous dispersion medium after the size of the droplets in the aqueous dispersion medium becomes uniform.

The polymerization initiator is added and mixed into the suspension with the primary droplets of the polymerizable monomer composition dispersed in the aqueous dispersion medium, and the resultant mixture is stirred by means of a high-speed shearing type agitator until the droplet diameter of the droplets becomes a small diameter near to the intended particle diameter of the colored polymer particles. In such a manner, fine secondary droplets generally having a volume average particle diameter of about 1 to 12 μm are formed.

The suspension containing the secondary droplets of the polymerizable monomer composition is charged into a polymerization reactor to conduct suspension polymerization at a temperature of generally 5 to 120° C., preferably 35 to 95° C., more preferably 50 to 95° C. Since a polymerization initiator high in catalytic activity must be used if the polymerization temperature is too low, it is difficult to control the polymerization reaction. If the polymerization temperature is too high, and an additive melted at a low temperature is contained, this additive may bleed on the surface of the resulting polymerized toner to deteriorate the storage stability. The polymerization reaction is preferably conducted for 1 to 20 hours, more preferably 2 to 15 hours.

The volume average droplet diameter and droplet diameter distribution of the fine droplets of the polymerizable monomer composition affect the volume average particle diameter and particle diameter distribution of the resulting polymerized toner. If the droplet diameter of the droplets is too great, the particle diameter of the colored polymer particles to be formed becomes too great to lower the resolution of an image to be formed. If the droplet diameter distribution of the droplets is too wide, the fixing temperature of the resulting polymerized toner varies, so that inconveniences such as fogging and toner filming tend to occur. Accordingly, the secondary droplets of the polymerizable monomer composition are desirably formed so as to have almost the same volume average droplet diameter and droplet diameter distribution as those in the colored polymer particles to be formed.

The volume average droplet diameter of the droplets of the polymerizable monomer composition is generally 1 to 15 μm, preferably 2 to 12 μm, more preferably 3 to 9 μm. When it is intended to provide a polymerized toner having a particularly small particle diameter for providing high-definition images, it is desirable to control the volume average droplet diameter of the droplets to preferably 2 to 9 μm, more preferably 3 to 8 μm, still more preferably 3 to 7 μm. The droplet diameter distribution (volume average droplet diameter/number average droplet diameter) of the droplets of the polymerizable monomer composition is generally 1 to 3, preferably 1 to 2.5, more preferably 1 to 2. When particularly fine droplets are formed, it is preferable to pass an aqueous dispersion medium containing the polymerizable monomer composition through between a rotor which rotates on its axis at high speed, and a stator surrounding it and having small openings or comb-like teeth.

As the polymerizable monomer, at least one is selected from among the above-mentioned monovinyl monomers. At this time, a polymerizable monomer or a combination of polymerizable monomers, which permits forming a polymer having a glass transition temperature Tg of the order of generally 80° C. or lower, preferably 40 to 80° C., more preferably 50 to 70° C., is preferably selected. The Tg of the polymer making up the binder resin is a calculated value, i.e., "calculated Tg", calculated out according to the kind(s) and proportion(s) of the polymerizable monomer(s) used.

As examples of the polymerization initiator, may be mentioned persulfates such as potassium persulfate and ammonium persulfate; azo compounds such as 4,4'-azobis(4-cyanovaleric acid), 2,2'-azobis(2-methyl-N-(2-hydroxy-ethyl) propionamide, 2,2'-azobis(2-amidinopropane) dihydrochloride, 2,2'-azobis(2,4-dimethylvaleronitrile) and 2,2'-azobisisobutyronitrile; and peroxides such di-t-butyl peroxide, benzoyl peroxide, t-butyl peroxy-2-ethylhexanoate, t-hexyl peroxy-2-ethyl hexanoate, t-butyl peroxypivalate, diisopropyl peroxydicarbonate, di-t-butyl peroxyisophthalate and t-butyl peroxyisobutyrate. Redox initiators composed of combinations of these polymerization initiators with a reducing agent may also be used.

The amount of the polymerization initiator used is generally 0.1 to 20 parts by weight, preferably 0.3 to 15 parts by weight, more preferably 0.5 to 10 parts by weight per 100 parts by weight of the polymerizable monomer. The polymerization initiator may be added into the aqueous dispersion medium containing the droplets of the polymerizable monomer composition, but may also be added into the polymerizable monomer composition in advance.

The suspension polymerization forms colored polymer particles with the additive components such as the colorant dispersed in the polymer of the polymerizable monomer. In the present invention, the colored polymer particles are used as a polymerized toner. In order to improve the storage stability (i.e., "blocking resistance"), low-temperature fixing ability and melting ability upon fixing of the resulting polymerized toner, an additional polymer layer may be formed on the colored polymer particles obtained by the suspension polymerization to provide core-shell type colored polymer particles.

As a process for forming the core-shell type structure, may be adopted, for example, a process in which the colored polymer particles are used as core particles, and a polymerizable monomer for shell is further polymerized in the presence of the core particles to form a polymer layer (shell) on each surface of the core particles.

When a monomer forming a polymer having a Tg higher than the Tg of the polymer component forming the core particles is used a polymerizable monomer for shell, the storage stability of the resulting polymerized toner can be improved. On the other hand, the Tg of the polymer component forming the core particles is preset low, thereby permitting lowering the fixing temperature of the resulting polymerized toner and improving the melting properties. Accordingly, the colored polymer particles of the core-shell structure are formed in the polymerization step, thereby providing a polymerized toner capable of meeting speeding-up of printing, formation of full-color images and permeability through an overhead projector (OHP).

As polymerizable monomers for forming the core and shell, respective preferable monomers may be suitably selected from among the above-mentioned monovinyl monomers. A weight ratio of the polymerizable monomer for core to the polymerizable monomer for shell is generally 40/60 to 99.9/0.1, preferably 60/40 to 99.7/0.3, more preferably 80/20 to 99.5/0.5. If the proportion of the polymerizable monomer for shell is too low, the effect of improving the storage stability of the resulting polymerized toner becomes little. If the proportion is too high on the other hand, the effect of lowering the fixing temperature of the resulting polymerized toner becomes little.

The Tg of the polymer formed from the polymerizable monomer for shell is generally higher than 50° C., but not higher than 120° C., preferably higher than 60° C., but not higher than 110° C., more preferably higher than 80° C., but not higher than 105° C. A difference in Tg between the polymer formed from the polymerizable monomer for core and the polymer formed from the polymerizable monomer for shell is preferably at least 10° C., more preferably at least 20° C., particularly preferably at least 30° C. In many cases, a monomer capable of forming a polymer having a Tg of generally at most 60° C., preferably 40 to 60° C. is preferably selected as the polymerizable monomer for core from the viewpoint of a balance between fixing temperature and storage stability. On the other hand, as the polymerizable monomer for shell, monomers capable of forming a polymer having a Tg higher than 80° C., such as styrene and methyl methacrylate, may be preferably used either singly or in combination of two or more monomers thereof.

The polymerizable monomer for shell is preferably added to the polymerization reaction system as droplets smaller than the average particle diameter of the core particles. If the droplet diameter of the droplets of the polymerizable monomer for shell is too great, it is difficult to uniformly form the polymer layer about the core particles. In order to form the polymerizable monomer for shell into fine droplets, it is only necessary to subject a mixture of the polymerizable monomer for shell and an aqueous dispersion medium to a finely dispersing treatment by means of, for example, an ultrasonic emulsifier and add the resultant dispersion to the polymerization reaction system.

When the polymerizable monomer for shell is a relatively water-soluble monomer (for example, methyl methacrylate) having a solubility of at least 0.1% by weight in water at 20° C., the monomer tends to relatively quickly migrate into the surfaces of the core particles, so that there is no need to conduct the finely dispersing treatment. However, it is preferable to conduct the finely dispersing treatment from the viewpoint of forming a uniform shell. On the other hand, when the polymerizable monomer for shell is a monomer (for example, styrene) having a solubility lower than 0.1% by weight in water at 20° C., it is preferable that the monomer be made liable to migrate into the surfaces of the core particles by conducting the finely dispersing treatment or adding an organic solvent (for example, an alcohol) having a solubility of at least 5% by weight in water at 20° C. to the reaction system.

A charge control agent may be added to the polymerizable monomer for shell if desired. As the charge control agent, may preferably be used the same charge control agent as that used in the production of the core particles. When the charge control agent is used, it is used in a proportion of generally 0.01 to 10 parts by weight, preferably 0.1 to 5 parts by weight per 100 parts by weight of the polymerizable monomer for shell.

In order to produce the colored polymer particles of the core-shell structure, the polymerizable monomer for shell or an aqueous dispersion thereof is added to the suspension containing the core particles in one lot, or continuously or intermittently. It is preferable from the viewpoint of efficient formation of the shell to add a water-soluble radical initiator at the time the polymerizable monomer for shell is added. It is considered that when the water-soluble polymerization initiator is added, the water-soluble initiator enters in the vicinity of each surface of the core particles to which the polymerizable monomer for shell has migrated, so that the polymer layer is easy to be formed on the core particle surfaces.

As examples of the water-soluble polymerization initiator, may be mentioned persulfates such as potassium persulfate and ammonium persulfate; and azo initiators such as 2,2'-azobis[2-methyl-N-(2-hydroxyethyl)propionamide and 2,2'-azobis-[2-methyl-N-[1,1-bis(hydroxymethyl)ethyl]-propionamide. The proportion of the water-soluble polymerization initiator used is generally 0.1 to 50 parts by weight, preferably 1 to 20 parts by weight per 100 parts by weight of the polymerizable monomer for shell.

The polymerization temperature for the polymerizable monomer for shell is preferably at least 50° C., more preferably 60 to 95° C. The polymerization reaction is preferably conducted for 1 to 20 hours, more preferably 2 to 15 hours.

The average thickness of the shell is generally 0.001 to 1.0 μm, preferably 0.003 to 0.5 μm, more preferably 0.005 to 0.2 μm. If the thickness of the shell is too great, the fixing ability of the resulting polymerized toner is deteriorated. If the thickness is too small on the other hand, the storage stability of the resulting polymerized toner is deteriorated.

The particle diameters of the core particles and the thickness of the shell in the polymerized toner can be determined by directly measuring the size and shell thickness of each of particles selected at random from electron photomicrographs thereof when they can be observed through an electron microscope. If the core and shell in each particle are difficult to observe through the electron microscope, the thickness of the shell can be calculated out from the particle diameter of the core particle and the amount of the polymerizable monomer used in forming the shell.

In the colored polymer particles of the core-shell structure, a balance between lowering of the fixing temperature and prevention of aggregation upon storage can be taken by coating a core layer composed of a substance having a low softening point with a substance having a softening point higher than the core layer.

After the formation of the colored polymer particles, the colored polymer particles are recovered from the aqueous dispersion medium. A step of removing volatile organic compounds such as unreacted polymerizable monomer(s) may be arranged prior to the recovery. A specific example thereof, may be adopted a process in which the aqueous dispersion containing the colored polymer particles is subjected to stripping treatment to remove volatile organic compounds.

A washing step is arranged after the step of forming the colored polymer particles, or the step of removing the volatile organic compounds as described above. In other words, the recovery of the colored polymer particles is conducted by dehydration, washing, filtration and drying in accordance with a method known per se in the art to recover dry colored polymer particles. Prior to the dehydration, for example, a treatment such as acid washing or alkali washing according to the kind of the dispersion stabilizer used is generally performed for the purpose of solubilizing the dispersion stabilizer to remove it.

For example, when colloid of a hardly water-soluble metal hydroxide, such as magnesium hydroxide colloid, is used as a dispersion stabilizer, an acid such as sulfuric acid is added to the aqueous dispersion to solubilize the dispersion stabilizer in water (this process being referred to as "acid washing"). The pH of the aqueous dispersion is adjusted to generally 6.5 or lower, preferably 5 or lower by the acid washing. As the acid added, may be used an inorganic acid such as sulfuric acid, hydrochloric acid or nitric acid, or an organic acid such as formic acid or acetic acid. However, sulfuric acid is particularly preferred because of high removing efficiency and small burden on production equipment.

After the acid washing or alkali washing, the aqueous dispersion is dehydrated by filtration. After the dehydration, the colored polymer particles are washed with wash water. It is preferable from the viewpoint of enhancing washing efficiency to conduct the feed of wash water and dehydration repeatedly or continuously. Therefore, a dehydrating and washing machine is preferably used to conduct washing with water. Examples of the dehydrating and washing machine include a continuous belt filter and a siphon peeler type centrifuge.

After the washing step, the colored polymer particles in the wetted state are dried. Drying methods include fluidized drying, vacuum drying and the like. However, vacuum drying capable of drying at a low temperature is preferred, with drying by a vacuum dryer equipped with a agitating blade being particularly preferred.

The volume average particle diameter Dv of the colored polymer particles (including colored polymer particles of the core-shell type) making up the polymerized toner according to the present invention is preferably 3 to 15 μm, more preferably 4 to 12 μm. If the volume average particle diameter Dv is smaller than the lower limit of the above range, the flowability of the resulting polymerized toner is lowered, and so its transferability may be lowered, blur may occur, or the printing density may be lowered. If this volume average particle diameter exceeds the upper limit of the above range, the resolution of an image formed with such a toner may be deteriorated in some cases. In order to provide a polymerized toner having a small particle diameter capable of forming high-definition images, it is desirable to control the volume average particle diameter Dv of the colored polymer particles to preferably 2 to 9 μm, more preferably 3 to 8 μm, still more preferably 3 to 7 μm.

A ratio Dv/Dp (particle diameter distribution) of the volume average particle diameter Dv to the number average particle diameter Dp of the colored polymer particles making up the polymerized toner according to the present invention is preferably 1.0 to 1.3, more preferably 1.0 to 1.2. If the particle diameter distribution Dv/Dp exceeds the upper limit of the above range, the resulting polymerized toner may tend to causes blur or lower transferability, printing density and resolution. The volume average particle diameter and number average particle diameter of the colored polymer particles can be measured by means of, for example, a Multisizer (manufactured by Beckmann Coulter Co., trade name).

The spheroidicity Sc/Sr of the colored polymer particles making up the polymerized toner according to the present invention is preferably 1.0 to 1.3, more preferably 1.0 to 1.2. If the spheroidicity Sc/Sr exceeds the upper limit of the above range, the transferability and flowability of the toner may be lowered, and the toner may tend to causes blur in some cases. The spheroidicity Sc/Sr of the colored polymer particles is determined in the following manner. The colored polymer particles are photographed by an electron microscope, and the resultant photograph is processed by means of an image processing analyzer [manufactured by NIRECO Corporation, trade name "LUZEX IID"] under conditions of an area rate of particles to a frame area of 2% in maximum and a total processing number of 100 particles. The thus-obtained spheroidicities Sc/Sr of 100 colored polymer particles are averaged to find an average spheroidicity.

$$\text{Spheroidicity}=Sc/Sr$$

wherein

Sc: an area of a circle supposing that the absolute maximum length of a particle is a diameter, Sr: a substantial projected area of the colored polymer particle.

5. Polymerized Toner:

The polymerized toner according to the present invention may also be used in development of electrophotographs as it is. In order to control the charging properties, flowability and storage stability, it is preferable to mix an external additive and optional other particles with the colored polymer particles, thereby attaching or embedding the external additive and the like on or in the surfaces of the colored polymer particles.

The external additives generally include inorganic particles and organic resin particles used for improving flowability and charging properties. Examples of the inorganic particles include particles of silica, alumina, titanium oxide, zinc oxide, tin oxide, calcium carbonate, calcium phosphate and cerium oxide. Examples of the organic resin particles include particles of methacrylic ester polymers, acrylic ester polymers, styrene-methacrylic ester copolymers, styrene-acrylic ester copolymers and melamine resins, and core-shell type particles in which the core is composed of a styrene polymer, and the shell is composed of a methacrylic ester polymer.

Among these, silica and titanium oxide are preferred, and particles subjected to a hydrophobicity-imparting treatment are more preferred, with silica particles subjected to a hydrophobicity-imparting treatment being particularly preferred. No particular limitation is imposed on the amount of the external additive added. However, it is generally 0.1 to 6 parts by weight per 100 parts by weight of the colored polymer particles. The polymerized toner according to the present invention is suitable for use as a non-magnetic one-component developer.

EXAMPLES

The present invention will hereinafter be described more specifically by the following examples and comparative examples. However, the present invention is not limited to these examples only. Incidentally, all designations of "part" or "parts" and "%" as will be used in the following examples mean part or parts by weight and % by weight unless expressly noted. Testing methods performed in EXAMPLES are as follows.

(1) Particle Diameter Measurement of Colorant:

A liquid polymerizable monomer mixture (preliminarily dispersed liquid polymerizable monomer mixture) containing a polymerizable monomer and a colorant was diluted to 1/20 with a styrene solution of a charge control agent (styrene/acrylic resin, product of Fujikura Kasei Co., Ltd., trade name "FCA-207P") to prepare a sample for particle diameter measurement. The thus-obtained sample was used to measure a volume average particle diameter Dv of the colorant and a volume percent $D_{51}$ of particles having a particle diameter of 51 μm or greater contained therein by means of an SALD particle size distribution meter (manufactured by Shimadzu Corporation).

(2) Viscosity:

A viscosity (initial viscosity) of a polymerizable monomer mixture (preliminarily dispersed polymerizable monomer mixture) prior to a dispersing step and a viscosity (viscosity after dispersion) of a dispersed polymerizable monomer mixture were measured by means of a Brookfield type viscometer (manufactured by Brookfield Co., model name "Digital-Rheometer DV-I+"). After the temperature of a sample was adjusted to 25° C. using a constant-temperature water bath, a spindle is rotated for 1 minute at a spindle speed of 60 rpm by the Brookfield type viscometer, and the viscosities were then measured.

As the spindle, the following spindle was used according to the range of viscosity to be measured of the sample.

Lower than 100 mPa·s: Spindle No. 1,

Not lower than 100 mPa·s, but lower than 200 mPa·s: Spindle No. 2,

Not lower than 200 mPa·s, but lower than 1,500 mPa·s: Spindle No. 3.

(3) Image Density:

A polymerized toner was placed in a commercially available printer of a non-magnetic one-component development system to conduct solid printing of a 50-mm square on paper for printing under an environment of 23° C. in temperature and 50% in humidity. At this time, a developing bias voltage was changed to change "developing rate M/A" that is an amount of the polymerized toner on the paper for printing, whereby an image density (printing density) of a solid-printed fixed image of a 5-mm square was measured by means of a reflection type densitometer (manufactured by Macbeth Co., model name "RD918") at the M/A of 0.45 mg/cm$^2$.

The M/A was calculated out in accordance with the following equation by taking an unfixed image out of the printer and blowing off the polymerized toner on the paper for printing after development with air.

$$M/A\ (\text{mg/cm}^2)=(W_1-W_2)/25\ \text{cm}^2$$

wherein $W_1$=weight (mg) of the paper for printing before blowing off the polymerized toner, $W_2$=weight (mg) of the paper for printing after blowing off the polymerized toner.

(4) Continuous Operation Stability in Dispersing Step:

After completion of the dispersing step, the media type dispersing machine used was disassembled to observe the condition in the casing, thereby visually evaluating the remaining state of aggregates of the colorant and the like. The evaluation standard is as follows:

A: Aggregates of the colorant and the like are scarcely observed,

B: Aggregates of the colorant remain in plenty in the media type dispersing machine, C: Aggregates of the colorant accumulate in the casing, and the media-separating screen is clogged with the polymerizable monomer mixture, thereby failing to continue the dispersing step.

(5) Retention of Dispersed Polymerizable Monomer Mixture:

A weight obtained by subtracting a weight of the dispersed polymerizable monomer mixture discharged out of the media type dispersing machine from a weight of the polymerizable monomer mixture (preliminarily dispersed polymerizable monomer mixture) poured into the media type dispersing machine in the dispersing step was regarded as a weight of a remaining dispersed polymerizable monomer mixture. The retention of the dispersed polymerizable monomer mixture was determined from the weight of the remaining dispersed polymerizable monomer mixture based on the weight of the polymerizable monomer mixture poured into the media type dispersing machine.

Example 1

A tank 101 shown in FIG. 1 was charged with 70 parts by weight of styrene, 20 parts by weight of butyl acrylate, 5.5 parts of a magenta colorant (product of Fuji Pigment Co., Ltd., trade name "Fuji Fast Carmine 528-1") obtained by mixing C.I Pigment Red 31 with C.I Pigment Red 150 and 0.275 part of an aluminum coupling agent (aluminum alkylacetoacetate diisopropylate; product of Ajinomoto Fine-Techno Co., Inc., trade name "AL-M"), and the mixture was stirred to prepare a liquid polymerizable monomer mixture.

Dv and $D_{51}$ of the magenta colorant in this liquid polymerizable monomer mixture were measured and found to be Dv=70.7 μm and $D_{51}$=68.4%.

This liquid polymerizable monomer mixture was preliminarily dispersed by means of an in-line type emulsifying and dispersing machine (manufactured by Ebara Corporation, trade name "Ebara Milder") as a pre-dispersing machine under conditions that a peripheral speed of the tip part of the rotor (agitating blade) is 23 m/sec, and the number θ of circulations is 26 times, thereby obtaining a preliminarily dispersed polymerizable monomer mixture. The temperature of the liquid mixture was controlled to 25° C. during the preliminarily dispersing treatment.

Dv and $D_{51}$ of the colorant in this preliminarily dispersed liquid polymerizable monomer mixture were measured and found to be Dv=3.1 μm and $D_{51}$=0%.

The dispersing step of the preliminarily dispersed liquid polymerizable monomer mixture obtained by the preliminary dispersion was carried out in the following manner by means of the dispersion system shown in FIG. 2 making use of the media type dispersing machine equipped with a media-separating screen shown in FIG. 3.

Space volume of casing: 5.47 liters,

Media particles: zirconia beads 0.3 mm in diameter,

Amount of media particles filled: 26.2 kg (85% of the space volume of the casing), Slit width in media-separating screen: 150 μm, and Peripheral speed of rotor tip: 10 m/sec.

The preliminarily dispersed polymerizable monomer mixture obtained in the preliminarily dispersing step was poured into the holding tank 205. At this time, the temperature of the liquid mixture in the holding tank 205 was controlled to 25° C. by introducing a temperature control medium (hot water or cold water) into the jacket 208 from the inlet 209 for the temperature control medium and discharging the medium from the outlet 210 for the temperature control medium.

This preliminarily dispersed liquid polymerizable monomer mixture was continuously fed into the media type dispersing machine 201 at a feed rate of 5 kg/min from the holding tank 205 using the circulating pump 213.

When the preliminarily dispersed liquid polymerizable monomer mixture was continuously fed, strong shearing force was caused to act on the mixture (liquid mixture) by centrifugal force generated by rotation of the rotor 316 and the vigorously moving media particles 317 to pulverize the magenta colorant. The preliminarily dispersed liquid polymerizable monomer mixture with the magenta colorant finely dispersed therein was separated from the media particles 317 by the media-separating screen 318 and discharged to the outside from the liquid outlet 304 through the liquid discharge path 325. The preliminarily dispersed liquid polymerizable monomer mixture discharged from the liquid outlet 304 was returned to the holding tank 205 through the line 215. The preliminarily dispersed liquid polymerizable monomer mixture with the magenta colorant finely dispersed therein, which had been returned to the holding tank 205, was continuously fed again into the media type dispersing machine 201 through the lines 212 and 214. In such a manner, the liquid mixture was subjected to dispersing treatment while being circulated through the media type dispersing machine.

During the dispersing treatment, the media particles 317 transferred in the vicinity of the surface of the media-separating screen 318 are returned to the dispersing chamber through the media particle-discharging slits 323 in the cylindrical part 324 provided at one end of the rotor 316 by a centrifugal effect between the rotating rotor 316 and the media-separating screen 318, thereby preventing the media particles from retaining on the surface of the media-separating screen 318. Accordingly, the pressure within the casing 302 was stably kept at 0.05 Mpa during the dispersing treatment. Cooling water was fed into a jacket 322 from a cooling medium inlet 320 and discharged from a cooling medium outlet 321 to make temperature control in such a manner that the temperature of the preliminarily dispersed liquid polymerizable monomer mixture with the magenta colorant finely dispersed therein, which is discharged from the liquid outlet 304, is kept to 25° C. during the operation.

The dispersing treatment was conducted until the number θ of circulations reached 4 times, and the operation was stopped. The viscosity of the dispersed polymerizable monomer mixture obtained by the dispersion by the media type dispersing machine was 400 mPa·s, and the ratio of increase in viscosity to the initial viscosity was 1.0 time.

To 90.275 parts of the dispersed polymerizable monomer mixture with the magenta colorant finely dispersed therein, were then added 10 parts of styrene, 5 parts of a charge control agent (styrene/acrylic resin, product of Fujikura Kasei Co., Ltd., trade name "FCA-207P"), 0.5 part of a polymethacrylic ester macromonomer (product of Toagosei Chemical Industry Co., Ltd., trade name "AA6"), 8 parts of dipentaerythritol hexamyristate, 1.2 parts of t-dodecylmercaptan as a molecular weight modifier and 0.3 part of divinylbenzene as a crosslinkable monomer, and the resultant mixture was stirred to prepare a polymerizable monomer composition.

On the other hand, an aqueous solution with 5 parts of sodium hydroxide (alkali metal hydroxide) dissolved in 50 parts of ion-exchanged water was gradually added to an aqueous solution with 6.5 parts of magnesium chloride (water-soluble polyvalent metal salt) dissolved in 250 parts of ion-exchanged water to prepare an aqueous dispersion medium containing magnesium hydroxide colloid (colloid of hardly water-soluble metal hydroxide).

After the polymerizable monomer composition was poured into the aqueous dispersion medium prepared above, and the resultant mixture was stirred, 5 parts of t-butyl peroxy-2-ethylhexanoate (product of Nippon Oil & Fats Co., Ltd., trade name "Perbutyl O") as a polymerization initiator was further poured, and the mixture was stirred for 10 minutes at 15,000 rpm under high shearing force by means of an in-line type emulsifying and dispersing machine (manufactured by Ebara Corporation, trade name "Ebara Milder") to form droplets of the polymerizable monomer composition.

A reactor equipped with an agitating blade was charged with the aqueous dispersion with the droplets of the polymerizable monomer composition dispersed therein to initiate a polymerization reaction at 90° C. After a conversion into a polymer reached almost 100%, 1 part of methyl methacrylate as a polymerizable monomer for shell and 0.1 part of 2,2'-azobis[2-methyl-N-(1,1-bis(hydroxy-methyl)-2-hydroxy-ethyl)propionamide] (product of Wako Pure Chemical Industries, Ltd., trade name "VA086") dissolved in 10 parts of ion-exchanged water were added while keeping the polymerization temperature intact to continue the reaction for 3 hours at 90° C. Thereafter, the reaction was stopped to obtain an aqueous dispersion containing core-shell type colored polymer particles. The pH of the aqueous dispersion was 9.5.

While stirring the above-obtained aqueous dispersion containing the colored polymer particles, the pH of the aqueous dispersion was adjusted to 6 or lower with sulfuric acid, and stirring was continued at 25° C. for 10 minutes to conduct acid washing. After water was then separated by filtration, 500 parts of ion-exchanged water was newly added to form a slurry again, and the slurry was stirred for 10 minutes and washed with water. After filtration, dehydration and water washing were repeated several times, colored polymer particles were separated by filtration to obtain wet colored polymer particles. The wet colored polymer particles were placed in a container of a vacuum dryer and vacuum-dried at 50° C. under a pressure of 4,000 Pa.

The particle diameter distribution of the colored polymer particles after the drying were such that the volume average particle diameter Dv was 6.76 μm, the number average particle diameter Dp was 5.89 μm, the volume percent of particles having a particle diameter of 16 μm or greater was 0.91%, and the volume percent of particles having a particle diameter of 20 μm or greater was 1.3%.

Into 100 parts of the colored polymer particles obtained above were added 0.8 part of finely particulate silica (product of Cabot Co., trade name "TG820F") subjected to a hydrophobicity-imparting treatment and 0.8 part of finely particulate silica (product of Nippon Aerosil Co., Ltd., trade name "NEA50") subjected to a hydrophobicity-imparting treatment, and they were mixed by means of a Henschel mixer to prepare a non-magnetic one-component polymerized toner. The results are shown in Table 1.

Example 2

A polymerized toner was prepared in the same manner as in Example 1 except that the amount of the colorant added in Example 1 was changed from 5.5 parts to 5.0 parts, the pre-dispersing machine was changed from the in-line type emulsifying and dispersing machine to a turbine type agitating machine (manufactured by Tokushu Kika Kogyo Co., Ltd., model name "TK Homomixer"), and the time of the preliminarily dispersing treatment was preset to 10 minutes. The results are shown in Table 1.

Example 3

A polymerized toner was prepared in the same manner as in Example 1 except that the number θ of circulations in the preliminarily dispersing step in Example 1 was changed from 26 times to 20 times, and the particle diameter of the media particles contained in the media type dispersing machine was changed from 0.3 mm to 0.1 mm. The results are shown in Table 1.

Example 4

A polymerized toner was prepared in the same manner as in Example 1 except that the colorant was changed from 5.5 parts of the magenta colorant in Example 1 to 7.0 parts of a yellow colorant, and the number θ of circulations in the preliminarily dispersing step was changed from 26 times to 6 times. As the yellow colorant, was used a colorant composed of 6 parts of "Fast Yellow 7415" (trade name, product of Sanyo Color Works, Ltd.) and 1 part of "Fast Yellow 7416" (trade name, product of Sanyo Color Works, Ltd.). The volume average particle diameter Dv of the yellow colorant used as a raw material was 72.0 μm, and a proportion of particles having a particle diameter of 51 μm or greater was 73.7% by volume. The results are shown in Table 1.

Example 5

A polymerized toner was prepared in the same manner as in Example 4 except that the colorant was changed from 7 parts of the yellow colorant in Example 4 to 5 parts of a cyan colorant (product of Dainippon Ink & Chemicals, Incorporated, trade name "CTBX121"). The results are shown in Table 1.

Comparative Example 1

A dispersing step was started in the same manner as in Example 4 except that no preliminarily dispersing step in Example 4 was conducted, and the particle diameter of the media particles contained in the media type dispersing machine was changed from 0.3 mm to 0.1 mm. However, the media type dispersing machine was clogged with the polymerizable monomer mixture at the time the number of circulations had reached 2.8 times, so that the dispersing step was terminated. A viscosity of the resultant liquid mixture was measured, and the subsequent process was stopped. The results are shown in Table 1.

Comparative Example 2

A polymerized toner was prepared in the same manner as in Example 1 except that the colorant was changed from 5.5 parts of the magenta colorant in Example 1 to 5 parts of a cyan colorant (product of Dainippon Ink & Chemicals, Incorporated, trade name "CTBX121"), the number θ of circulations in the preliminarily dispersing step was changed from 26 times to 2 times, and the number θ of circulations in the dispersing step was changed from 4 times to once. The results are shown in Table 1.

Comparative Example 3

A polymerized toner was prepared in the same manner as in Example 1 except that the number θ of circulations in the preliminarily dispersing step was changed from 26 times in Example 1 to 2 times, and the particle diameter of the media particles contained in the media type dispersing machine was changed from 0.3 mm to 0.1 mm. The results are shown in Table 1.

TABLE 1

| | Example | | | | | Comparative Example | | |
|---|---|---|---|---|---|---|---|---|
| | 1 | 2 | 3 | 4 | 5 | 1 | 2 | 3 |
| Colorant | | | | | | | | |
| Kind | Magenta | Magenta | Magenta | Yellow | Cyan | Yellow | Cyan | Magenta |
| Amount added (parts) | 5.5 | 5.0 | 5.5 | 7.0 | 5.0 | 7.0 | 5.0 | 5.5 |
| Pre-dispersing step | | | | | | | | |
| Pre-dispersing machine | Milder | TK Homo-mixer | Milder | Milder | Milder | — | Milder | Milder |
| Number of circulations (times) | 26 | — | 20 | 6 | 6 | — | 2 | 2 |
| Treating time (min) | — | 10 | — | — | — | — | — | — |
| Colorant | | | | | | | | |
| Dv (μm) | 3.1 | 28.7 | 8.2 | 16.4 | 4.8 | 72.0 | 6.4 | 35.9 |
| $D_{51}$ (vol. %) | 0 | 27.1 | 4.7 | 17.6 | 0 | 73.7 | 0 | 45.5 |
| Dispersing step | | | | | | | | |
| Number of circulations (times) | 4.0 | 4.0 | 4.0 | 4.0 | 4.0 | 2.8 | 1.0 | 4.0 |
| Diameter of media particles (mm) | 0.3 | 0.3 | 0.1 | 0.3 | 0.3 | 0.1 | 0.3 | 0.1 |
| Viscosity of monomer mixture | | | | | | | | |
| Initial viscosity (mPa) | 392 | 456 | 258 | 1212 | 15 | 1.3 | 7.5 | 118 |
| Viscosity after dispersion | 400 | 948 | 1380 | 1286 | 132 | 1020 | 55 | 1250 |
| Ratio of increase in vis. | 1.0 | 2.1 | 5.3 | 1.1 | 8.8 | 785 | 7.3 | 11 |
| Evaluation | | | | | | | | |
| Stability to continuous operation in dispersing step | A | A | A | A | A | C | B | B |
| Image density of toner | 1.42 | 1.38 | 1.44 | 1.32 | 1.36 | — | 1.10 | 1.26 |

From the test results shown in Table 1, the following facts are known.

When a polymerizable monomer mixture, the initial viscosity of which was lower (higher than 1 mPa·s, but lower than 10 mPa·s) than the lower limit of the range prescribed in the first production process of the present invention, was used, and the ratio of increase in viscosity was higher than the upper limit of the prescribed range (Comparative Example 1), the media type dispersing machine was clogged with the polymerizable monomer mixture during the dispersing step to fail to continue the dispersing step.

When the initial viscosity of the polymerizable monomer mixture was lower (higher than 1 mPa·s, but lower than 10 mPa·s) than the lower limit of the range prescribed in the first production process of the present invention, the stability to operation in the dispersing step became poor even when the ratio of increase in viscosity was controlled within the prescribed range (Comparative Example 2), so that the dispersion of the colorant in the polymerizable monomer was not sufficiently achieved, and so the image density of the resultant polymerized toner was low. Aggregates of the colorant remained in plenty in the media type dispersing machine.

When the ratio of increase in viscosity exceeded 10 times (Comparative Example 3) even when the initial viscosity of the polymerizable monomer mixture fell within the range prescribed in the first production process of the present invention, the stability to operation in the dispersing step became insufficient, and the image density of the resultant polymerized toner was low.

On the other hand, according to the first production process (Examples 1 to 5), the stability to continuous operation in the dispersing step became excellent, and so the polymerized toners excellent in image density could be provided.

Example 6

A tank 101 shown in FIG. 1 was charged with 70 parts by weight of styrene, 20 parts by weight of butyl acrylate, 5.0 parts of a cyan colorant (product of Dainippon Ink & Chemicals, Incorporated, trade name "FASTOGEN Blue GCTF") and 0.5 part of a charge control agent (styrene/acrylic resin, product of Fujikura Kasei Co., Ltd., trade name "FCA-161P") to prepare a polymerizable monomer mixture.

This polymerizable monomer mixture was preliminarily dispersed by means of an in-line type emulsifying and dispersing machine (manufactured by Ebara Corporation, trade name "Ebara Milder") as a pre-dispersing machine under conditions that a peripheral speed of the tip part of the rotor (agitating blade) is 23 m/sec, and the number θ of circulations is 6 times, thereby obtaining a preliminarily dispersed polymerizable monomer mixture. The temperature of the liquid mixture was controlled to 25° C. during the preliminarily dispersing treatment.

Dv and $D_{51}$ of the colorant in this preliminarily dispersed liquid polymerizable monomer mixture were measured and found to be Dv=6.5 μm and $D_{51}$=0%.

The dispersing step of the preliminarily dispersed liquid polymerizable monomer mixture obtained by the preliminary dispersion was carried out in the following manner by means of the dispersion system shown in FIG. 2 making use of the media type dispersing machine equipped with a media-separating screen shown in FIG. 3.

Space volume of casing: 5.47 liters,

Media particles: zirconia beads 0.1 mm in diameter,

Amount of media particles filled: 26.2 kg (85% of the space volume of the casing), Slit width in media-separating screen: 150 μm, and Peripheral speed of rotor tip: 10 m/sec.

The preliminarily dispersed polymerizable monomer mixture obtained in the preliminarily dispersing step was poured into the holding tank 205. At this time, the temperature of the liquid mixture in the holding tank 205 was controlled to 25° C. by introducing a temperature control medium (hot water or cold water) into the jacket 208 from the inlet 209 for the temperature control medium and discharging the medium from the outlet 210 for the temperature control medium.

This preliminarily dispersed liquid polymerizable monomer mixture was continuously fed into the media type dispersing machine 201 at a feed rate of 5 kg/min from the holding tank 205 using the circulating pump 213.

When the preliminarily dispersed polymerizable monomer mixture was continuously fed, strong shearing force was caused to act on the mixture (liquid mixture) by centrifugal force generated by rotation of the rotor 316 and the vigorously moving media particles 317 to pulverize the cyan colorant. The preliminarily dispersed liquid polymerizable monomer mixture with the cyan colorant finely dispersed therein was separated from the media particles 317 by the media-separating screen 318 and discharged to the outside from the liquid outlet 304 through the liquid discharge path 325. The preliminarily dispersed liquid polymerizable monomer mixture discharged from the liquid outlet 304 was returned to the holding tank 205 through the line 215. The preliminarily dispersed liquid polymerizable monomer mixture with the cyan colorant finely dispersed therein, which had been returned to the holding tank 205, was continuously fed again into the media type dispersing machine 201 through the lines 212 and 214. In such a manner, the liquid mixture was subjected to dispersing treatment while being circulated through the media type dispersing machine.

During the dispersing treatment, the media particles 317 transferred in the vicinity of the surface of the media-separating screen 318 are returned to the dispersing chamber through the media particle-discharging slits 323 in the cylindrical part 324 provided at one end of the rotor 316 by a centrifugal effect between the rotating rotor 316 and the media-separating screen 318, thereby preventing the media particles from retaining on the surface of the media-separating screen 318. Accordingly, the pressure within the casing 302 was stably kept at 0.03 Mpa during the dispersing treatment. Cooling water was fed into a jacket 322 from a cooling medium inlet 320 and discharged from a cooling medium outlet 321 to make temperature control in such a manner that the temperature of the preliminarily dispersed liquid polymerizable monomer mixture with the cyan colorant finely dispersed therein, which is discharged from the liquid outlet 304, is kept to 25° C. during the operation.

The dispersing treatment was conducted until the number θ of circulations reached 4 times, and the operation was stopped. The viscosity of the dispersed polymerizable monomer mixture obtained by the dispersion by the media type dispersing machine was 478 mPa·s, and the ratio of increase in viscosity to the initial viscosity was 683 times.

To 106 parts of the dispersed polymerizable monomer mixture with the cyan colorant finely dispersed therein, were then added 5 parts of a charge control agent (styrene/acrylic resin, product of Fujikura Kasei Co., Ltd., trade name "FCA-207P"), 0.25 part of a polymethacrylic ester macromonomer (product of Toagosei Chemical Industry Co., Ltd., trade name "AA6"), 6 parts of dipentaerythritol hexamyristate, 1.6 parts of t-dodecylmercaptan as a molecular weight modifier and 0.7 part of divinylbenzene as a crosslinkable monomer, and the resultant mixture was stirred to prepare a polymerizable monomer composition.

On the other hand, an aqueous solution with 5 parts of sodium hydroxide (alkali metal hydroxide) dissolved in 50 parts of ion-exchanged water was gradually added to an aqueous solution with 6.5 parts of magnesium chloride (water-soluble polyvalent metal salt) dissolved in 250 parts of ion-exchanged water to prepare an aqueous dispersion medium containing magnesium hydroxide colloid (colloid of hardly water-soluble metal hydroxide).

After the polymerizable monomer composition was poured into the aqueous dispersion medium prepared above, and the resultant mixture was stirred, 5 parts of t-butyl peroxy-2-ethylhexanoate (product of Nippon Oil & Fats Co., Ltd., trade name "Perbutyl O") as a polymerization initiator was further poured, and the mixture was stirred for 10 minutes at 15,000 rpm under high shearing force by means of an in-line type emulsifying and dispersing machine (manufactured by Ebara Corporation, trade name "Ebara Milder") to form droplets of the polymerizable monomer composition.

A reactor equipped with an agitating blade was charged with the aqueous dispersion with the droplets of the polymerizable monomer composition dispersed therein to initiate a polymerization reaction at 90° C. After a conversion into a polymer reached almost 100%, 1 part of methyl methacrylate as a polymerizable monomer for shell and 0.1 part of 2,2'-azobis[2-methyl-N-[1,1-bis(hydroxy-methyl)-2-hydroxy-ethyl]propionamide] (product of Wako Pure Chemical Industries, Ltd., trade name "VA086") dissolved in 10 parts of ion-exchanged water were added while keeping the polymerization temperature intact to continue the reaction for 3 hours at 90° C. Thereafter, the reaction was stopped to obtain an aqueous dispersion containing core-shell type colored polymer particles. The pH of the aqueous dispersion was 9.5.

While stirring the above-obtained aqueous dispersion containing the colored polymer particles, the pH of the aqueous dispersion was adjusted to 6 or lower with sulfuric acid, and stirring was continued at 25° C. for 10 minutes to conduct acid washing. After water was then separated by filtration, 500 parts of ion-exchanged water was newly added to form a slurry again, and the slurry was stirred for 10 minutes and washed with water. After filtration, dehydration and water washing were repeated several times, colored polymer particles were separated by filtration to obtain wet colored polymer particles. The wet colored polymer particles were placed in a container of a vacuum dryer and vacuum-dried at 50° C. under a pressure of 4,000 Pa.

The particle diameter distribution of the colored polymer particles after the drying were such that the volume average particle diameter Dv was 9.57 μm, the number average particle diameter Dp was 8.17 μm, the volume percent of particles having a particle diameter of 16 μm or greater was 1.25%, and the volume percent of particles having a particle diameter of 20 μm or greater was 1.56%.

Into 100 parts of the colored polymer particles obtained above were added 1 part of finely particulate silica (product of Cabot Co., trade name "TG820F") subjected to a hydrophobicity-imparting treatment and 1.0 part of finely particulate silica (product of Nippon Aerosil Co., Ltd., trade name "NEA50") subjected to a hydrophobicity-imparting treatment, and they were mixed by means of a Henschel mixer to prepare a non-magnetic one-component polymerized toner. The results are shown in Table 2.

Example 7

A polymerized toner was prepared in the same manner as in Example 6 except that the particle diameter of the media particles used in the media type dispersing machine was changed from 0.1 mm to 0.3 mm. The results are shown in Table 2.

Comparative Example 4

A dispersing step was started in the same manner as in Example 6 except that the colorant was changed from 5.0 parts of the cyan colorant (product of Dainippon Ink & Chemicals, Incorporated, trade name "FASTOGEN Blue GCTF") in Example 6 to 7 parts of a yellow colorant, and no preliminarily dispersing step was conducted. However, the media type dispersing machine was clogged with the preliminarily dispersed polymerizable monomer mixture at the time the number of circulations had reached 2.8 times, so that the dispersing step was completed. A viscosity of a dispersed polymerizable monomer mixture obtained at this time was measured, and the subsequent process was stopped. The results are shown in Table 2.

Comparative Example 5

A polymerized toner was prepared in the same manner as in Example 7 except that the number θ of circulations in the preliminarily dispersing step was changed from 6 times in Example 7 to 2 times, and the number θ of circulations in the dispersing step was changed from 4 times to once. The results are shown in Table 2.

TABLE 2

| | Example | | Comp. Example | |
|---|---|---|---|---|
| | 6 | 7 | 4 | 5 |
| Colorant | | | | |
| Kind | Cyan | Cyan | Yellow | Cyan |
| Amount added (parts) | 5.0 | 5.0 | 7.0 | 5.0 |
| Pre-dispersing step | | | | |
| Pre-dispersing machine | Milder | Milder | — | Milder |
| Number of circulations (times) | 6 | 6 | — | 2 |
| Colorant | | | | |
| Dv (μm) | 6.5 | 6.5 | 72.0 | 6.4 |
| $D_{51}$ (vol. %) | 0 | 0 | 73.7 | 0 |
| Dispersing step | | | | |
| Number of circulations (times) | 4.0 | 4.0 | 2.8 | 1.0 |
| Diameter of media particles (mm) | 0.1 | 0.3 | 0.1 | 0.3 |
| Viscosity of monomer mixture | | | | |
| Initial viscosity (mPa) | 0.7 | 0.7 | 1.3 | 7.5 |
| Viscosity after dispersion | 478 | 124 | 1020 | 55 |
| Ratio of increase in vis. | 683 | 177 | 785 | 7.3 |
| Evaluation | | | | |
| Stability to continuous operation in dispersing step | A | A | C | B |
| Retention of monomer mixture (%) | 0.3 | 0.2 | 3.5 | 0.2 |
| Image density of toner | 1.39 | 1.32 | — | 1.10 |

From the test results shown in Table 2, the following facts are known.

When no preliminarily dispersing step was conducted, and the initial viscosity was higher (higher than 1 mPa·s, but lower than 10 mPa·s) than the upper limit of the range prescribed in the second production process of the present invention, the media type dispersing machine was clogged with the polymerizable monomer mixture during the dispersing step even when the ratio of increase in viscosity was controlled within the prescribed range (Comparative Example 4), so that the dispersing step could not be continued.

When the initial viscosity was higher (higher than 1 mPa·s, but lower than 10 mPa·s) than the upper limit of the range prescribed in the second production process of the present invention, and the ratio of increase in viscosity was lower (Comparative Example 5) than the lower limit of the prescribed range, the stability to operation in the dispersing step became poor, and the dispersion of the colorant in the polymerizable monomer was not sufficiently achieved, and so the image density of the resultant polymerized toner was low.

On the other hand, according to the second production process (Examples 6 and 7), the stability to continuous operation in the dispersing step became excellent, and so the polymerized toners excellent in image density could be provided. In addition, the amount of the dispersed polymerizable monomer mixture remaining in the media type dispersing machine was little.

INDUSTRIAL APPLICABILITY

According to the present invention, there are provided processed for stably and efficiently producing a polymerized toner capable of conducting printing excellent in printing density and color tone.

The polymerized toners obtained by the production processed of the present invention can be used as developers in image forming apparatus by an electrophotographic system, such as facsimiles, copying machines and printers.

What is claimed is:

1. A process for producing a polymerized toner, comprising the step of polymerizing a polymerizable monomer composition containing a polymerizable monomer and a colorant in the presence of a polymerization initiator in an aqueous dispersion medium to form colored polymer particles, the process comprising the following Steps 1 to 5:

(a) Step 1 of mixing the polymerizable monomer with the colorant to prepare a polymerizable monomer mixture having an initial viscosity of 150 to 1,500 mPa·s as measured at 25° C. by a Brookfield type viscometer, wherein the mixing is conducted as preliminary dispersion by a dispersing machine, and the initial viscosity is a viscosity measured after the preliminary dispersion, wherein the dispersing machine applies mechanical shearing force to the polymerizable monomer with the colorant to preliminarily disperse the colorant by the dispersing machine having high shearing force, wherein the dispersing machine is a different type of machine than a media type dispersing machine, and wherein the colorant contained in the polymerizable monomer mixture prepared by the preliminary dispersion includes particles having a particle diameter of at least 51 μm in a proportion of 0 to 30 volume percent, and has a volume average particle diameter of at most 30 μm;

(b) Step 2 of feeding the polymerizable monomer mixture to a media type dispersing machine to finely disperse the colorant by the media type dispersing machine, thereby preparing a dispersed polymerizable monomer mixture having a viscosity after the dispersion, the ratio of increase in viscosity of which is 1.0 to 10 times as high as the initial viscosity, wherein the media type dispersing machine is a media type dispersing machine equipped with a media-separating screen;

(c) Step 3 of providing the dispersed polymerizable monomer mixture as the polymerizable monomer composition as it is, or preparing the polymerizable monomer composition by dissolving or dispersing other additive components for toner than the colorant into the dispersed polymerizable monomer mixture;

(d) Step 4 of dispersing the polymerizable monomer composition in the aqueous dispersion medium to form droplets of the polymerizable monomer composition; and (e) Step 5 of polymerizing the polymerizable monomer composition dispersed as the droplets in the aqueous dispersion medium in the presence of the polymerization initiator to form the colored polymer particles.

2. The production process according to claim 1, wherein, in Step 2, a dispersed polymerizable monomer mixture having a viscosity after the dispersion, the ratio of increase in viscosity of which is 1.0 to 9.9 times as high as the initial viscosity, is prepared.

3. The production process according to claim 1, wherein the media type dispersing machine is a media type dispersing machine having a structure that a driving shaft, and a rotor and a media-separating screen, which are arranged on the driving shaft and can be rotated simultaneously in cooperation with the rotation of the driving shaft, are provided within a cylindrical casing having a liquid inlet and a liquid outlet.

4. The production process according to claim 1, wherein the particle diameter of the media particles contained in the media type dispersing machine is 0.05 to 0.5 mm.

5. The production process according to claim 1, wherein, in Step 2, the polymerizable monomer mixture passes through the media type dispersing machine in the number of circulations of 1 to 30 times.

6. A process for producing a polymerized toner, comprising the step of polymerizing a polymerizable monomer composition containing a polymerizable monomer and a colorant in the presence of a polymerization initiator in an aqueous dispersion medium to form colored polymer particles, the process comprising the following Steps I to V:

(1) Step I of mixing the polymerizable monomer with the colorant to prepare a polymerizable monomer mixture having an initial viscosity of 0.3 to 0.9 mPa·s as measured at 25° C. by a Brookfield type viscometer, wherein the mixing is conducted as preliminary dispersion by a dispersing machine, and the initial viscosity is a viscosity measured after the preliminary dispersion, wherein the dispersing machine applies mechanical shearing force to the polymerizable monomer with the colorant to preliminarily disperse the colorant by the dispersing machine having high shearing force, wherein the dispersing machine is a different type of machine than a media type dispersing machine, and wherein the colorant contained in the polymerizable monomer mixture prepared by the preliminary dispersion includes particles having a particle diameter of at least 51 μm in a proportion of 0 to 30 volume percent, and has a volume average particle diameter of at most 30 μm;

(2) Step II of feeding the polymerizable monomer mixture to a media type dispersing machine to finely disperse the colorant by the media type dispersing machine, thereby preparing a dispersed polymerizable monomer mixture having a viscosity after the dispersion, the ratio of increase in viscosity of which is 100 to 2,000 times as high as the initial viscosity, wherein the media type dispersing machine is a media type dispersing machine equipped with a media-separating screen;

(3) Step III of providing the dispersed polymerizable monomer mixture as the polymerizable monomer composition as it is, or preparing the polymerizable monomer composition by dissolving or dispersing other additive components for toner than the colorant into the dispersed polymerizable monomer mixture;

(4) Step IV of dispersing the polymerizable monomer composition in the aqueous dispersion medium to form droplets of the polymerizable monomer composition; and (5) Step V of polymerizing the polymerizable monomer composition dispersed as the droplets in the aqueous dispersion medium in the presence of the polymerization initiator to form the colored polymer particles.

7. The production process according to claim 6, wherein, in Step II, a dispersed polymerizable monomer mixture having a viscosity after the dispersion, the ratio of increase in viscosity of which is 130 to 1,500 times as high as the initial viscosity, is prepared.

8. The production process according to claim 6, wherein the media type dispersing machine is a media type dispersing machine having a structure that a driving shaft, and a rotor and a media-separating screen, which are arranged on the driving shaft and can be rotated simultaneously in cooperation with the rotation of the driving shaft, are provided within a cylindrical casing having a liquid inlet and a liquid outlet.

9. The production process according to claim 6, wherein the particle diameter of the media particles contained in the media type dispersing machine is 0.05 to 0.5 mm.

10. The production process according to claim 6, wherein, in Step II, the polymerizable monomer mixture passes through the media type dispersing machine in the number of circulations of 1 to 30 times.

* * * * *